US008585557B2

(12) United States Patent
Ikegami

(10) Patent No.: US 8,585,557 B2
(45) Date of Patent: Nov. 19, 2013

(54) TRAMPOLINE WITH COLLAPSIBLE ENCLOSURE ASSEMBLY

(75) Inventor: Masato Ikegami, Kitakyushu (JP)

(73) Assignee: ABC Trampoline Ltd., Hong Kong (CN)

( * ) Notice: Subject to any disclaimer, the term of this patent is extended or adjusted under 35 U.S.C. 154(b) by 162 days.

(21) Appl. No.: 13/009,782

(22) Filed: Jan. 19, 2011

(65) Prior Publication Data

US 2011/0207582 A1 Aug. 25, 2011

Related U.S. Application Data

(60) Provisional application No. 61/307,248, filed on Feb. 23, 2010.

(51) Int. Cl.
*A63B 21/00* (2006.01)

(52) U.S. Cl.
USPC ..... 482/27; 482/28

(58) Field of Classification Search
USPC ..... 482/124, 121, 27; 135/133
See application file for complete search history.

(56) References Cited

U.S. PATENT DOCUMENTS

| | | | | |
|---|---|---|---|---|
| 3,339,925 A | | 9/1967 | Nissen | |
| 3,995,649 A | * | 12/1976 | Robichaud | 135/133 |
| 5,711,743 A | * | 1/1998 | Nichols et al. | 482/27 |
| 5,833,557 A | | 11/1998 | Cole | |
| 5,941,798 A | | 8/1999 | Coan et al. | |
| 6,053,845 A | | 4/2000 | Publicover et al. | |
| 6,132,922 A | * | 10/2000 | Fukae et al. | 430/118.2 |
| 6,135,922 A | | 10/2000 | Nissen | |

(Continued)

FOREIGN PATENT DOCUMENTS

| | | |
|---|---|---|
| CN | 2860536 Y | 11/2005 |
| CN | 2899854 | 5/2007 |

(Continued)

OTHER PUBLICATIONS

Extended European Search Report and European Search Opinion for European Application No. 11 153 987.0, publication date Nov. 3, 2011, FUNTEK USA, Inc.

(Continued)

*Primary Examiner* — Jerome w Donnelly
(74) *Attorney, Agent, or Firm* — Roeder & Broder LLP

(57) ABSTRACT

An enclosure assembly (22) for use with a trampoline assembly (10) comprises a plurality of support arches (32) including at least a first support arch (32A) and a second support arch (32B) that are hingably secured to a base frame (14). The second support arch (32B) overlaps the first support arch (32A) and is selectively secured to the first support arch (32A). The plurality of support arches (32) can further include a third support arch (32C) and a fourth support arch (32D) that are hingably secured to the base frame (14). The third support arch (32C) and the fourth support arch (32D) overlap and are selectively secured to at least one of the other support arches (32). The plurality of support arches (32) are selectively movable between an upright configuration and a collapsed configuration. When the first support arch (32A) is in the upright configuration, one or more of the other support arches (32B-32D) are inhibited from being moved from the upright configuration to the collapsed configuration. Additionally, when the first support arch (32A) is in the collapsed configuration, one or more of the other support arches (32B-32D) are inhibited from being moved from the collapsed configuration to the upright configuration.

26 Claims, 17 Drawing Sheets

(56) References Cited

U.S. PATENT DOCUMENTS

| | | | |
|---|---|---|---|
| 6,336,893 | B1 | 1/2002 | Chen |
| 7,331,903 | B2 | 2/2008 | Nissen |
| D614,715 | S | 4/2010 | Mann |
| 8,197,390 | B2 | 6/2012 | Ikegami |
| 2003/0064861 | A1 | 4/2003 | Chen |
| 2004/0053712 | A1 | 3/2004 | Allison |
| 2006/0270525 | A1 | 11/2006 | Colling |
| 2009/0280961 | A1 | 11/2009 | Ikegami |
| 2010/0285926 | A1 | 11/2010 | Ikegami |

FOREIGN PATENT DOCUMENTS

| | | | |
|---|---|---|---|
| CN | 201179293 | Y | 1/2009 |
| EP | 1504794 | A1 | 2/2005 |
| EP | 2030654 | A2 | 3/2009 |
| EP | 2116283 | A1 | 11/2009 |
| FR | 2623719 | A1 | 6/1989 |
| GB | 000874839-0001 | A1 | 2/2008 |
| GB | 000874839-0002 | A1 | 2/2008 |
| GB | 000874839-0003 | A1 | 2/2008 |
| GB | 000874839-0004 | A1 | 2/2008 |
| GB | 000874839-0005 | A1 | 2/2008 |
| GB | 000874839-0006 | A1 | 2/2008 |
| GB | 000874839-0007 | A1 | 2/2008 |
| GB | 2468622 | A | 9/2010 |
| WO | WO2005/058428 | A1 | 6/2005 |
| WO | WO2009/098324 | A2 | 8/2009 |
| WO | WO2009/098324 | A3 | 8/2009 |

OTHER PUBLICATIONS

Written Opinion of the International Searching Authority for PCT/EP20091051468, publication date Aug. 13, 2009, TP Activity Toys Limited.

Optics-Patents Renewal Details, Improvements in or Relating to Trampolines, Oct. 25, 2010, 74 pages, Publication No. GB2468622, Tube Plastics Limited, Inc. United Kingdom.

Extended European Search Report for European Application No. 10161889.0, publication date Aug. 23, 2010, FUNTEK USA, Inc.

HME News, Photo of Trade Publication "MedTrade" for tradeshow in Orlando, FL (US), Oct. 26, 2004, Health Bounce on front page, Nielsen Company, US.

European Patent Office Communication of Oct. 22, 2012 for European Patent Application No. EP 11 153 987.0 (related application).

Response to European Patent Office Communication filed Feb. 22, 2013 for European Patent Application No. EP 11 153 987.0 (related application).

European Patent Office Communication of Apr. 8, 2013 for European Patent Application No. EP 11 153 987.0 (related application).

Response to European Patent Office Communication filed Oct. 4, 2013 for European Patent Application No. EP 11 153 987.0 (related application).

* cited by examiner

TRAMPOLINE WITH COLLAPSIBLE ENCLOSURE ASSEMBLY

RELATED APPLICATION

This application claims priority on U.S. Provisional Application Ser. No. 61/307,248 filed on Feb. 23, 2010 and entitled "Trampoline With Collapsible Enclosure Assembly". As far as is permitted, the contents of U.S. Provisional Application Ser. No. 61/307,248 are incorporated herein by reference.

BACKGROUND

For many, many years bouncing on a trampoline has been viewed as a fun and entertaining activity for people of various ages. However, with the great increase in sales and popularity of home and backyard recreational trampolines, there has been a corresponding increase in the number of injuries. Many trampoline injuries result from a fall off of the trampoline due to loss of orientation and/or loss of control. Additionally, many of the injuries occur when the trampoline is being used by young and/or inexperienced people without proper supervision.

In recent years, trampoline enclosures have become a popular means utilized to decrease the number of injuries that occur due to falls from trampolines. Unfortunately, current trampoline enclosures typically use a straight support design that is not always strong enough or sturdy enough to prevent injuries when a person jumps into the side of the enclosure. Additionally, current enclosures do not provide an adequate means for preventing or inhibiting unsupervised use of the trampolines. Accordingly, there is a need for a trampoline enclosure that can withstand a greater amount of direct force while still enabling the user to remain on the trampoline bed surface. Further, there is a need for a trampoline enclosure that can provide a means to inhibit unwanted and/or unsupervised use of the trampoline.

SUMMARY

The present invention is directed to an enclosure assembly for use with a trampoline assembly, the trampoline assembly including a base frame. In certain embodiments, the enclosure assembly comprises a plurality of support arches including at least a first support arch and a second support arch that are hingably secured to the base frame. In such embodiments, the second support arch overlaps the first support arch and is selectively secured to the first support arch.

In some embodiments, the plurality of support arches further includes a third support arch that is hingably secured to the base frame. In such embodiments, the third support arch can overlap the second support arch and can be selectively secured to the second support arch. Additionally, in such embodiments, the third support arch can overlap the first support arch and can be selectively secured to the first support arch.

Additionally, in one embodiment, the plurality of support arches further includes a fourth support arch that is hingably secured to the base frame. In such embodiment, the fourth support arch overlaps the third support arch and is selectively secured to the third support arch. Moreover, the fourth support arch can overlap the first support arch and can be selectively secured to the first support arch.

In certain embodiments, the plurality of support arches are selectively movable between an upright configuration and a collapsed configuration. In such embodiments, when the first support arch is in the upright configuration, one or more of the other support arches are inhibited from being moved from the upright configuration to the collapsed configuration. Additionally, in such embodiments, when the first support arch is in the collapsed configuration, one or more of the other support arches are inhibited from being moved from the collapsed configuration to the upright configuration. Further, in one such embodiment, when the plurality of support arches are in the collapsed configuration, the support arches are positioned substantially within the perimeter of the base frame.

In one embodiment, the plurality of support arches cooperate to extend substantially fully around the perimeter of the base frame.

Further, in certain embodiments, the enclosure assembly further comprises an enclosure that is selectively coupled to the plurality of support arches.

Additionally, the present invention is further directed to a trampoline assembly including a base frame and the enclosure assembly as described above.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which.

DESCRIPTION

Figure 1:
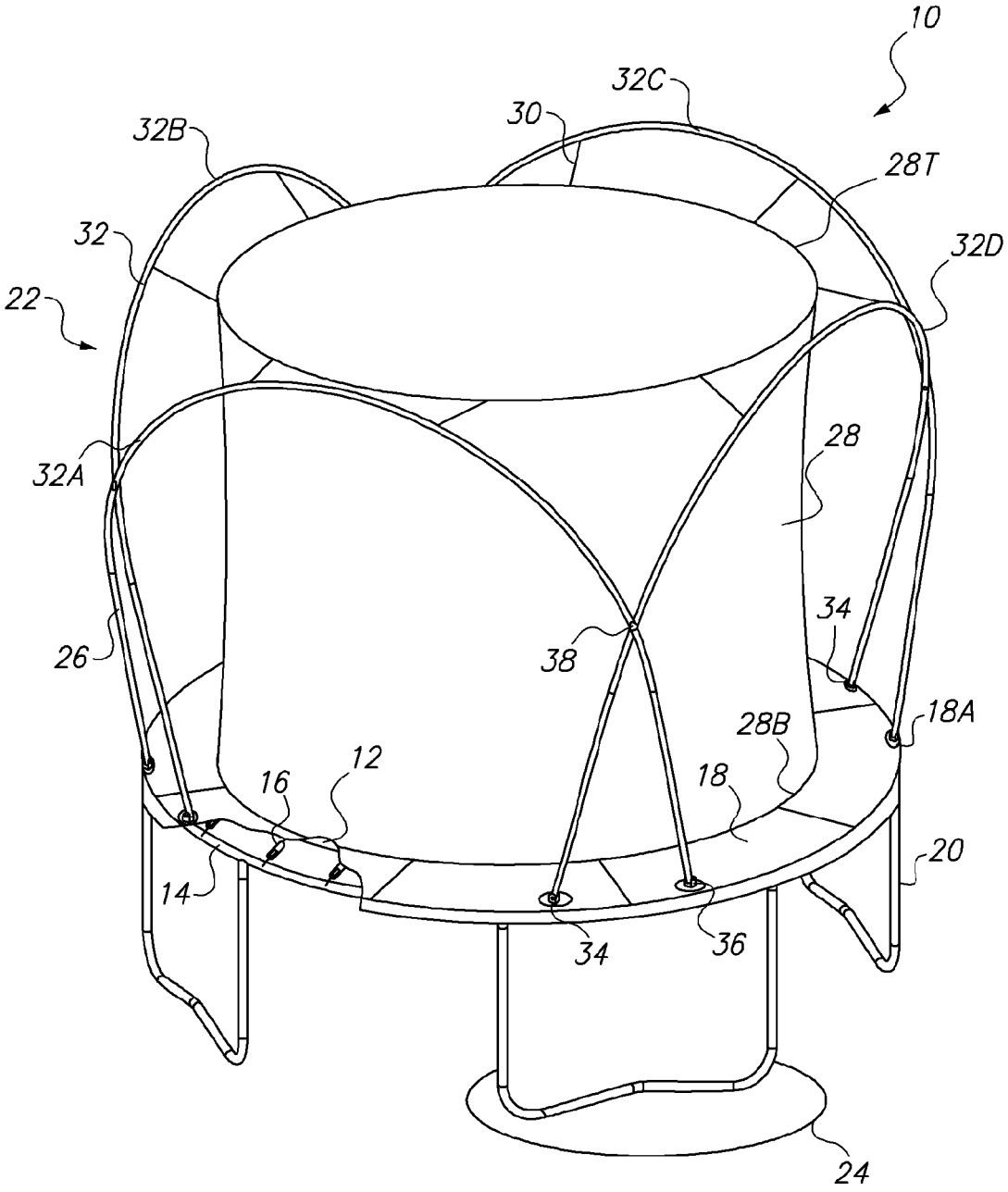
FIG. 1 is a perspective view of an embodiment of a trampoline assembly having features of the present invention.

FIG. 1 is a perspective view of an embodiment of a trampoline assembly 10 having features of the present invention. In this embodiment, the trampoline assembly 10 includes a bed 12 (only partially illustrated in FIG. 1), a base frame 14 (a portion of which is illustrated in FIG. 1), a plurality of resilient members 16 (some of which are illustrated in FIG. 1), a cover 18, a plurality of legs 20, and an enclosure assembly 22. The plurality of resilient members 16 connect the bed 12 to the base frame 14, so as to place the bed 12 in tension.

As an overview, the trampoline assembly 10, as described in detail herein, is uniquely designed so that the enclosure assembly 22 exhibits improved strength and sturdiness characteristics during use. Additionally, the enclosure assembly 22 is uniquely designed to inhibit unwanted and/or unsupervised use of the trampoline assembly 10. More particularly, the enclosure assembly 22 is designed so that the enclosure assembly 22 can be quickly and easily put up and taken down, i.e. moved between a working configuration and a non-working configuration, by one person so as to inhibit unwanted and/or unsupervised use of the trampoline assembly 10.

The design of the bed 12 can be varied depending upon the requirements of the trampoline assembly 10 and/or the base frame 14. In the embodiment illustrated in FIG. 1, the bed 12 is substantially circular in shape. For example, in certain non-exclusive alternative embodiments, the bed 12 can have a diameter of approximately seven, nine, eleven, thirteen or fourteen feet. Alternatively, the bed 12 can have a diameter of greater than fourteen feet or less than seven feet. Still alternatively, the bed 12 can be substantially oval shaped, square shaped, rectangle shaped, or some other shape.

Further, the bed 12 can be formed from various sturdy fabric materials that are designed to withstand the repeated impact from a person using the trampoline assembly 10. For example, the bed 12 can be formed from a mesh material or other similar material. Alternatively, the bed 12 can be formed from materials including heavy canvas, vinyl, or nylon.

The design of the base frame 14 can be varied depending on the requirements of the trampoline assembly 10, the bed 12 and/or the plurality of resilient members 16. In the embodiment illustrated in FIG. 1, the base frame 14 is substantially circular in shape. For example, in certain non-exclusive alternative embodiments, the base frame 14 can have a diameter of approximately eight, ten, twelve, fourteen or fifteen feet. Alternatively, the base frame 14 can have a diameter of greater than fifteen feet or less than eight feet. Still alternatively, the base frame 14 can be substantially oval shaped, square shaped, rectangle shaped, or some other shape.

In certain embodiments, the base frame 14 can include a plurality of sections that can be secured together to form the base frame 14. For example, in one embodiment, the base frame 14 is formed from a pair of sections that are each substantially semi-circular in shape. With this modular-type design, shipping and disassembly for storage of the base frame 14 is facilitated. Alternatively, the base frame 14 can be formed as a unitary structure. Further, the base frame 14 can be formed from various materials such as metal, wood, plastic, composite materials, ceramic, or any other suitably rigid materials. Alternatively, a combination of any of such materials can be used.

As noted above, the plurality of resilient members 16 connect the bed 12 to the base frame 14, so as to maintain the bed 12 in tension. Each resilient member 16 can include a spring, elastic, plastic, rubber, or other suitably resilient structure. The size and number of the resilient members 16 can vary. For example, in one embodiment, the trampoline assembly 10 can include approximately 48 similarly-sized extension springs that are equally spaced around the perimeter of the bed 12. Further, in one embodiment, each spring can have a diameter of approximately twenty-two millimeters and be formed from 3.2 millimeter thickness spring steel. Alternatively, the trampoline assembly 10 can be designed to have greater than 48 or fewer than 48 springs, and the trampoline assembly 10 can utilize springs that have various dimensions and are made of various materials.

The cover 18 substantially covers at least a portion of the plurality of resilient members 16 and at least a portion of the base frame 14 (a portion of the cover 18 is cut away in FIG. 1 to illustrate a portion of the base frame 14 and some of the plurality of resilient members 16). The cover 18 is designed to help protect the user from injury by preventing the user from getting hands or feet or other body parts caught or pinched within the plurality of resilient members 16. Additionally, the cover 18 is designed to help protect the user from injury by preventing the user from directly contacting the rigid materials used to form the base frame 14. The cover 18 can be made of nylon or other suitable, pliable material. In certain embodiments, a layer of padding (not illustrated in FIG. 1) can be positioned between the cover 18 and the plurality of resilient members 16 and between the cover 18 and the base frame 14.

The legs 20 are connected to the base frame 14 and are spaced apart around the base frame 14, so as to maintain the base frame 14 and the bed 12 above a support surface 24, such as a floor or the ground. The configuration of the legs 20 and the number of legs 20 can vary. For example, in the embodiment illustrated in FIG. 1, the trampoline assembly 10 includes four legs 20 (only three are illustrated in FIG. 1) that are spaced apart around the base frame 14. In this embodiment, each leg 20 can be somewhat W-shaped for rigidity and strength. Further, with this design, each leg 20 has one or more contact points with the support surface 24 for increased stability. Alternatively, the trampoline assembly 10 can be designed to have more than four or less than four legs 20, and the legs 20 can have other than a W-shaped design. For example, in certain embodiments, the legs 20 can have a straight leg design.

The enclosure assembly 22 is removably and hingably coupled to the base frame 14. Additionally, the enclosure assembly 22 is selectively movable between a working configuration, as illustrated in FIG. 1, wherein the enclosure assembly 22 is positioned to protect the user during use of the trampoline assembly 10, and a non-working configuration (not illustrated), wherein the enclosure assembly 22 is folded down and/or removed from the base frame 14.

The design of the enclosure assembly 22 can be varied depending on the requirements of the trampoline assembly 10, the bed 12, and/or the base frame 14. In the embodiment illustrated in FIG. 1, the enclosure assembly 22 includes an enclosure frame 26, an enclosure 28, and a plurality of enclosure connectors 30 that selectively connect the enclosure 28 to the enclosure frame 26.

Figure 2A:
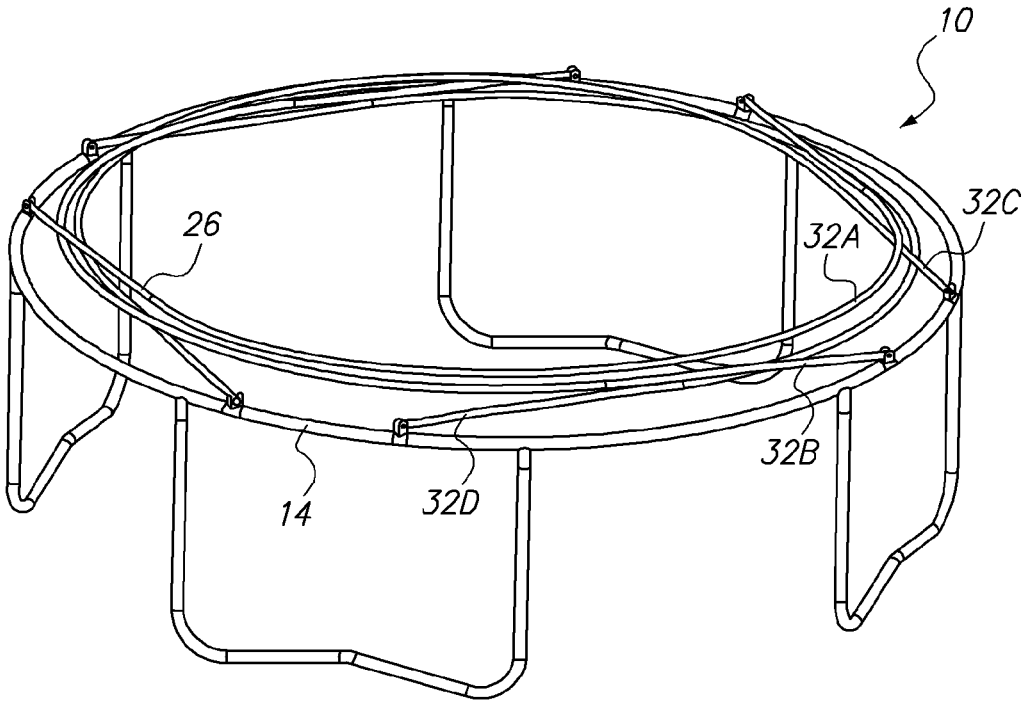
FIG. 2A is a simplified perspective view of a portion of the trampoline assembly illustrated in FIG. 1, wherein the enclosure frame is positioned in the collapsed configuration.

The enclosure frame 26 includes a plurality of support arches 32 that are removably and hingably secured to the base frame 14 and that are selectively secured to one or more of the other support arches 32. For example, in this embodiment, each of the support arches 32 is selectively secured to two of the other support arches 32. The enclosure frame 26 is selectively movable between an upright configuration (as illustrated In FIG. 2E), wherein the enclosure assembly 22 can be positioned in the working configuration, and a collapsed configuration (as illustrated in FIG. 2A), wherein the enclosure assembly 22 is positioned in the non-working configuration. The movement of the enclosure frame 26 between the collapsed configuration and the upright configuration is illustrated and described in greater detail below in relation to FIGS. 2A-2E.

In the embodiment illustrated in FIG. 1, the enclosure frame 26 includes four support arches 32, i.e. a first support arch 32A, a second support arch 32B, a third support arch 32C, and a fourth support arch 32D. Alternatively, the enclosure frame 26 can be designed to include more than four or less than four support arches 32. For example, in certain non-exclusive alternative embodiments, the enclosure frame 26 includes three support arches 32 or five support arches 32. In certain designs, the number of arches 32 is increased as the size of the trampoline is increased. An example of a suitable enclosure frame 26 for the trampoline assembly 10 is provided in U.S. Pat. No. 6,135,922, issued to Nissen. To the extent permitted, the disclosure of U.S. Pat. No. 6,135,922 is incorporated herein by reference.

The plurality of support arches 32, as illustrated in FIG. 1, are removably and hingably connected to the base frame 14 and extend upward away from the base frame 14. With this design, each of the support arches 32 can be selectively pivoted relative to the base frame 14 between the upright configuration and the collapsed configuration. Additionally, each support arch 32 extends slightly outward radially from the center of the bed 12, so that an apex of each support arch 32 is substantially directly above the base frame 14. Further, each support arch 32 has a pair of spaced apart support arch ends 34 that are removably and hingably secured to the base frame 14 with a pair of base connectors 36. Alternatively, the support arch ends 34 can extend somewhat below the level of the base frame 14, with areas of the support arch 32 close to the support arch ends 34 being secured to the base frame 14. A specific embodiment of the design of the base connectors 36 will be discussed in greater detail below.

In certain embodiments, the cover 18 includes a plurality of cover apertures 18A that are spaced apart around the perimeter of the cover 18 and that are adapted to be positioned adjacent to the base frame 14. The cover apertures 18A are designed to ensure the proper positioning of the support arches 32 around the base frame 14, as each of the base connectors 36 is adapted to be properly positioned substantially within one of the cover apertures 18A. Additionally, the cover apertures 18A enable the cover 18 to be utilized on alternative, yet similarly sized, base frames, while still ensuring that the support arches 32 can be properly positioned around the base frame. Thus, the cover 18 with the cover apertures 18A can be used as a template to properly locate the base connectors 36 on the base frame 14. With this design, the cover 18 can be used to as a template to retrofit existing trampolines.

As shown in the embodiment illustrated in FIG. 1, each support arch 32 can be further selectively connected to two of the other support arches 32 with one or more arch connectors 38. With this design, the support arches 32 are able to create a much sturdier structure for the enclosure assembly 22, to better support the enclosure 26, and to better protect the user when using the trampoline assembly 10. The arch connectors 38 can include some sort of bracket connector or some other type of connector that enables each support arch 32 to be securely attached to two of the other support arches 32.

In the embodiment illustrated in FIG. 1, the enclosure assembly 22 includes the first support arch 32A, the second support arch 32B, the third support arch 32C and the fourth support arch 32D that cooperate to extend substantially fully around the perimeter of the base frame 14. Alternatively, the support arches 32A-32D can cooperate to extend less than fully around the perimeter of the base frame 14.

As illustrated, each support arch 32A-32D overlaps somewhat and is selectively connected to the adjacent support arches 32A-32D with one of the arch connectors 38. In other words, the first support arch 32A overlaps with and is selectively connected to the second support arch 32B with an arch connector 38 and overlaps with and is selectively connected to the fourth support arch 32D with an arch connector 38; the second support arch 32B overlaps with and is selectively connected to the first support arch 32A with an arch connector 38 and overlaps with and is selectively connected to the third support arch 32C with an arch connector 38; the third support arch 32C overlaps with and is selectively connected to the second support arch 32B with an arch connector 38 and overlaps with and is selectively connected to the fourth support arch 32D with an arch connector 38; and the fourth support arch 32D overlaps with and is selectively connected to the third support arch 32C with an arch connector 38 and overlaps with and is selectively connected to the first support arch 32A with an arch connector 38.

It should be noted the terms "first support arch", "second support arch", "third support arch" and "fourth support arch" are used merely for purposes of convenience and for identifying relative positioning of similar features. Further, any of the support arches can equally be referred to as the first support arch, the second support arch, the third support arch and/or the fourth support arch.

The height of the arch connectors 38 and the degree of overlap of the adjacent support arches 32 can be varied depending upon the requirements of the enclosure assembly 22. In the embodiment illustrated in FIG. 1, the arch connectors 38 are positioned at a point that is approximately one-half of the way up the overall height of the support arch 32.

Further, the adjacent support arches 32 are shown to overlap by between approximately fifteen and thirty degrees around the circumference or perimeter of the base frame 14. Alternatively, the arch connectors 38 can be positioned so that they are higher or lower than shown in FIG. 1, and the adjacent support arches 32 can overlap by more than thirty degrees or less than fifteen degrees around the circumference of the base frame 14.

The design of the enclosure 28 can be varied to suit the requirements of the trampoline assembly 10 and/or the enclosure assembly 22. As illustrated, the enclosure 28 extends from a bottom edge 28B that is at approximately the same height as the base frame 14 to an opposed top edge 28T that is at a height that is at or near the height of the top of the support arches 32. With this design, the enclosure 28 forms an enclosed area within which the user can jump on the bed 12 of the trampoline assembly 10. In certain embodiments, the enclosure 28 can be formed from a lightweight but strong netting or resilient fabric material that is designed to be opaque or semi-opaque so as to enable the user to be viewed from outside the enclosure 28 and to allow the user to see outside of the enclosure 28. For example, suitable materials for the enclosure include polypropylene, nylon, high density polyethylene, and Dacron polyester. The flexible or resilient material utilized to form the enclosure 28 is designed to absorb the force of impact when a user collides against the side of the enclosure 28 and to prevent the user from falling off the bed 12 of the trampoline assembly 10.

The plurality of enclosure connectors 30 connect the enclosure 28 to the enclosure frame 26, so as to maintain the top edge 28T of the enclosure 28 in tension. In the embodiment illustrated in FIG. 1, the enclosure connectors 30 extend substantially between the top edge 28T of the enclosure 28 and the enclosure frame 26. In particular, in one embodiment, the enclosure connectors 30 can be fixedly secured to the top edge 28T of the enclosure 28, and the enclosure connectors 30 can be selectively attached to the enclosure frame 26. Alternatively, the enclosure connectors 30 can be selectively attached to the top edge 28T of the enclosure 28 and/or the enclosure connectors 30 can be fixedly secured to the enclosure frame 26.

Each enclosure connector 30 can include a flexible or resilient tie, a spring, elastic, plastic, rubber, or other suitably resilient structure. In the embodiment illustrated in FIG. 1, the enclosure assembly 22 includes eight enclosure connectors 30, wherein two enclosure connectors 30 are utilized to connect the enclosure 28 to each support arch 32 of the enclosure frame 26. Alternatively, the enclosure assembly 22 can be designed to include more than eight enclosure connectors 30 or less than eight enclosure connectors 30, and/or the specific positioning of the enclosure connectors 30 can be varied.

Additionally, the bottom edge 28B of the enclosure 28 is further secured to one or more of the base frame 14, the cover 18, the bed 12, and the plurality of resilient members 16, so as to maintain the bottom edge 28B of the enclosure 28 in tension. By maintaining both the top edge 28T and the bottom edge 28B of the enclosure 28 in tension, the enclosure 28 is able to better support and protect the user of the trampoline assembly 10 when and if the user contacts the enclosure 28 during use of the trampoline assembly 10.

Figure 2B:
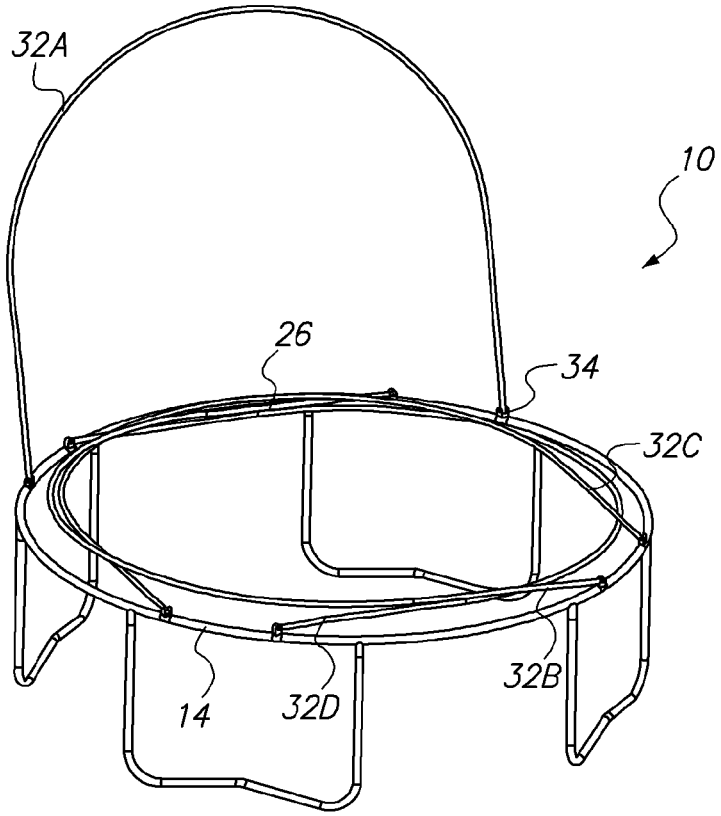
FIG. 2B is a simplified perspective view of a portion of the trampoline assembly illustrated in FIG. 1, wherein the enclosure frame is moved partially toward the upright configuration.
Figure 2C:
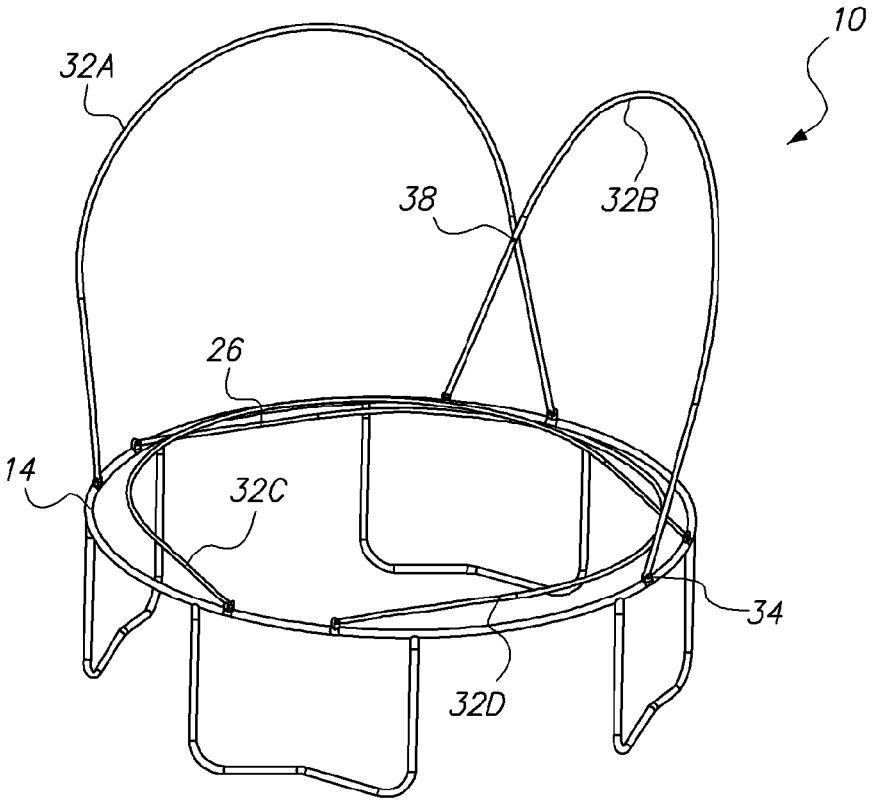
FIG. 2C is a simplified perspective view of a portion of the trampoline assembly illustrated in FIG. 1, wherein the enclosure frame is moved further toward the upright configuration.
Figure 2D:
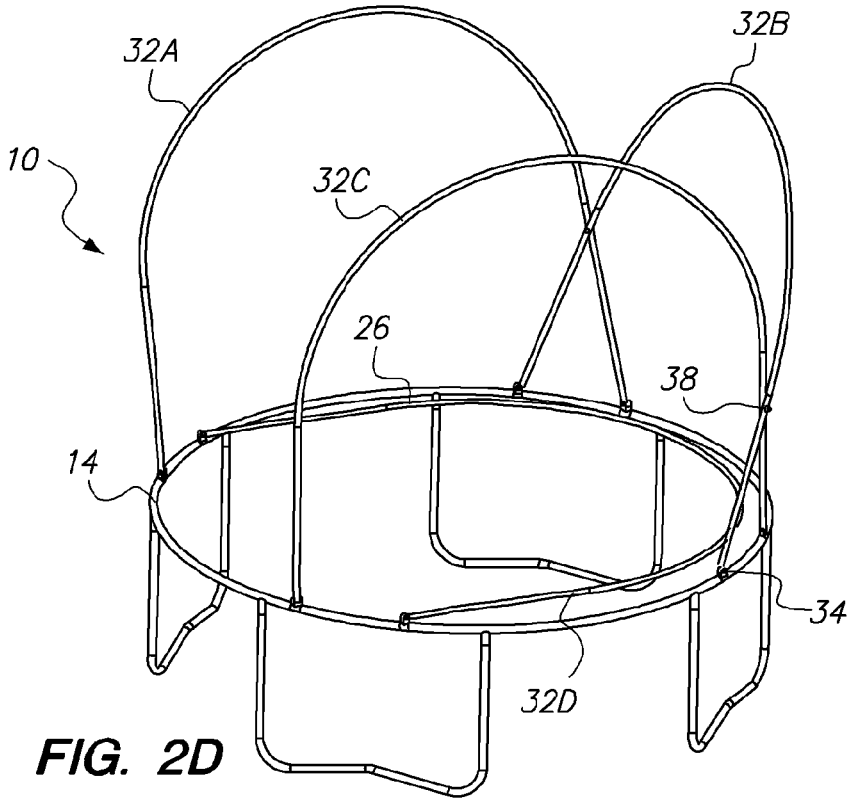
FIG. 2D is a simplified perspective view of a portion of the trampoline assembly illustrated in FIG. 1, wherein the enclosure frame is moved still further toward the upright configuration.
Figure 2E:
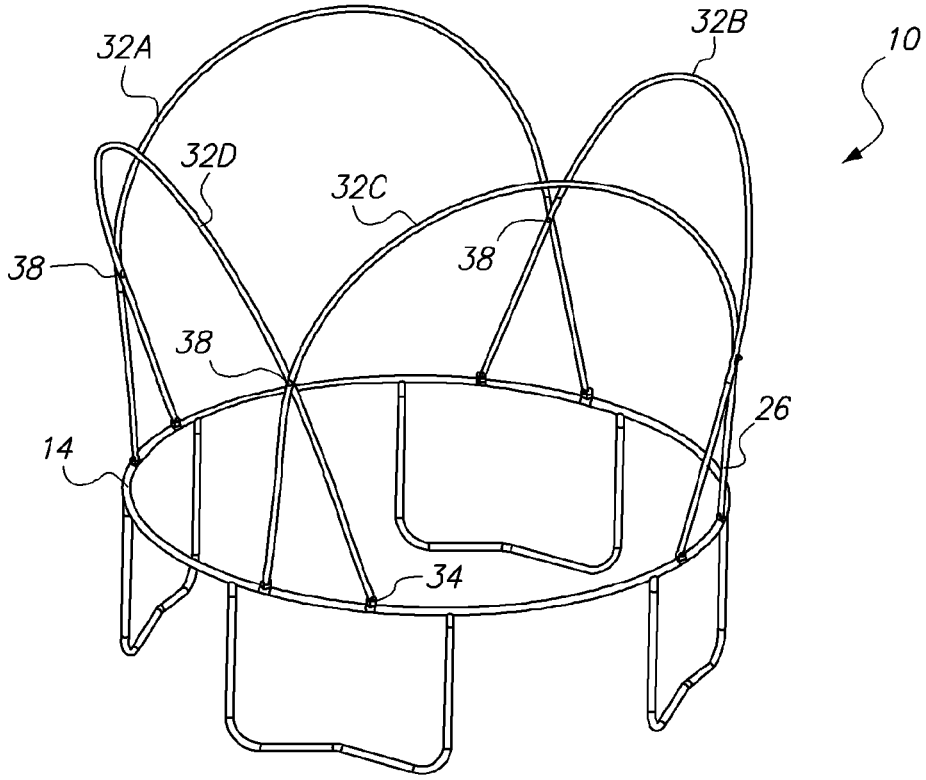
FIG. 2E is a simplified perspective view of a portion of the trampoline assembly illustrated in FIG. 1, wherein the enclosure frame is positioned in the upright configuration.

FIGS. 2A-2E illustrate one non-exclusive example of the gradual movement of the enclosure frame 26 from the collapsed configuration (illustrated in FIG. 2A) to the upright configuration (illustrated in FIG. 2E). In particular, FIG. 2A is a simplified perspective view of a portion of the trampoline assembly 10 illustrated in FIG. 1, wherein the enclosure frame 26 is positioned fully in the collapsed configuration; FIG. 2B is a simplified perspective view of a portion of the trampoline assembly 10 illustrated in FIG. 1, wherein the enclosure frame 26 is moved partially toward the upright configuration; FIG. 2C is a simplified perspective view of a portion of the trampoline assembly 10 illustrated in FIG. 1, wherein the enclosure frame 26 is moved further toward the upright configuration; FIG. 2D is a simplified perspective view of a portion of the trampoline assembly 10 illustrated in FIG. 1, wherein the enclosure frame 26 is moved still further toward the upright configuration; and FIG. 2E is a simplified perspective view of a portion of the trampoline assembly 10 illustrated in FIG. 1, wherein the enclosure frame 26 is positioned fully in the upright configuration.

In FIG. 2A, each of the first support arch 32A, the second support arch 32B, the third support arch 32C, and the fourth support arch 32D are positioned substantially adjacent to one another in a folded down or collapsed position on the bed 12 (illustrated in FIG. 1) of the trampoline assembly 10. More particularly, as illustrated in FIG. 2A, the enclosure frame 26 is positioned fully in the collapsed configuration, and the trampoline assembly 10 is protected from unwanted and/or unsupervised use. In different embodiments, the support arches 32A-32D can be adapted to be rotated upward into an upright position consecutively in a clockwise direction, in a counter-clockwise direction, or in some other order.

Moreover, as shown in the embodiment illustrated in FIG. 2A, when the enclosure frame 26 is in the collapsed configuration, all of the support arches 32A-32D are positioned substantially within the perimeter of the base frame 14. Stated another way, when the enclosure frame 26 is in the collapsed configuration, no portion of any of the support arches 32A-32D extends outside the perimeter of the base frame 14. With this design, a person cannot lean on a portion of the support arches 32A-32D outside the perimeter of the base frame 14, which may cause the base frame 14 to tip or may otherwise cause damage to the support arches 32A-32D and/or the base frame 14.

Additionally, in this embodiment, when the first support arch 32A is in the collapsed configuration, the second support arch 32B, the third support arch 32C and the fourth support arch 32D are inhibited from being moved from the collapsed configuration to the upright configuration.

In FIG. 2B, a portion of the enclosure frame 26, i.e. the first support arch 32A, has been moved to the upright position wherein the apex of the first support arch 32A is positioned away from the base frame 14. More particularly, with each support arch end 34 of the first support arch 32A being hingably and/or pivotably coupled to the base frame 14, the first support arch 32A has been rotated in a generally upward direction so that the first support arch 32A is no longer folded down or collapsed on the bed 12 (illustrated in FIG. 1) of the trampoline assembly 10. Additionally, as illustrated in FIG. 2B, the second support arch 32B, the third support arch 32C and the fourth support arch 32D are still in the folded down or collapsed position on the bed 12 of the trampoline assembly 10.

Additionally, in this embodiment, when the first support arch 32A is in the upright configuration and the second support arch 32B is in the collapsed configuration, the third support arch 32C and the fourth support arch 32D are inhibited from being moved from the collapsed configuration to the upright configuration.

In FIG. 2C, another portion of the enclosure frame 26, i.e. the second support arch 32B, has been moved to the upright position wherein the apex of the second support arch 32B is positioned away from the base frame 14. As illustrated, the second support arch 32B is now positioned substantially adjacent to the first support arch 32A in the upright position. More particularly, with each support arch end 34 of the second support arch 32B being hingably and/or pivotably coupled to the base frame 14, the second support arch 32B has been rotated in a generally upward direction so that the second support arch 32B is no longer folded down or collapsed on the bed 12 (illustrated in FIG. 1) of the trampoline assembly 10. Additionally, as illustrated in FIG. 2C, the third support arch 32C and the fourth support arch 32D are still in the folded down or collapsed position on the bed 12 of the trampoline assembly 10.

Further, as illustrated in FIG. 2C, once the second support arch 32B has been positioned in the upright position substantially adjacent to the first support arch 32A, an arch connector 38 can be utilized to selectively secure the second support arch 32B to the first support arch 32A. More particularly, in one embodiment, the arch connector 38 selectively secures the outer edge of the second support arch 32B to the inner edge of the first support arch 32A. Moreover, the use of the arch connector 38 better enables the maintaining of the first support arch 32A and the second support arch 32B in the upright position while the remaining support arches 32C, 32D are awaiting movement into the upright position.

Additionally, in this embodiment, when the first support arch 32A and the second support arch 32B are in the upright configuration, and the third support arch 32C is in the collapsed configuration, the fourth support arch 32D is inhibited from being moved from the collapsed configuration to the upright configuration. Further, in this embodiment, with the second support arch 32B being in the upright configuration, the first support arch 32A is inhibited from being moved from the upright configuration to the collapsed configuration.

In FIG. 2D, another portion of the enclosure frame 26, i.e. the third support arch 32C, has been moved to the upright position wherein the apex of the third support arch 32C is positioned away from the base frame 14. As illustrated, the third support arch 32C is now positioned substantially adjacent to the second support arch 32B in the upright position. More particularly, with each support arch end 34 of the third support arch 32C being hingably and/or pivotably coupled to the base frame 14, the third support arch 32C has been rotated in a generally upward direction so that the third support arch 32C is no longer folded down or collapsed on the bed 12 (illustrated in FIG. 1) of the trampoline assembly 10. Additionally, as illustrated in FIG. 2D, the fourth support arch 32D is still in the folded down or collapsed position on the bed 12 of the trampoline assembly 10.

Further, as illustrated in FIG. 2D, once the third support arch 32C has been positioned in the upright position substantially adjacent to the second support arch 32B, an arch connector 38 can be utilized to selectively secure the third support arch 32C to the second support arch 32B. More particularly, in one embodiment, the arch connector 38 selectively secures the outer edge of the third support arch 32C to the inner edge of the second support arch 32B. Moreover, the use of the arch connectors 38 better enables the maintaining of the first support arch 32A, the second support arch 32B and the third support arch 32C in the upright position while the fourth support arch 32D is awaiting movement into the upright position.

Additionally, in this embodiment, when the third support arch 32C is in the upright configuration, the first support arch 32A and the second support arch 32B are inhibited from being moved from the upright configuration to the collapsed configuration.

In FIG. 2E, another portion of the enclosure frame 26, i.e. the fourth support arch 32D, has been moved to the upright position wherein the apex of the fourth support arch 32D is positioned away from the base frame 14. As illustrated, the fourth support arch 32D is now positioned substantially adjacent to the third support arch 32C and the first support arch 32A in the upright position. More particularly, with each support arch end 34 of the fourth support arch 32D being hingably and/or pivotably coupled to the base frame 14, the fourth support arch 32D has been rotated in a generally upward direction so that the fourth support arch 32D is no longer folded down or collapsed on the bed 12 (illustrated in FIG. 1) of the trampoline assembly 10.

Further, as illustrated in FIG. 2E, once the fourth support arch 32D has been positioned in the upright position substantially adjacent to the third support arch 32C and the first support arch 32A, an arch connector 38 can be utilized to selectively secure the fourth support arch 32D to each of the third support arch 32C and the first support arch 32A. More particularly, in one embodiment, an arch connector 38 selectively secures the outer edge of the fourth support arch 32D to the inner edge of the third support arch 32C, and an arch connector 38 selectively secures the outer edge of the fourth support arch 32D to the inner edge of the first support arch 32A. Moreover, the use of the arch connectors 38 better enables the maintaining of the first support arch 32A, the second support arch 32B, the third support arch 32C and the fourth support arch 32D in the upright position.

Additionally, in this embodiment, when the fourth support arch 32D is in the upright configuration, the first support arch 32A, the second support arch 32B and the third support arch 32C are inhibited from being moved from the upright configuration to the collapsed configuration.

In summary, in this embodiment, when the enclosure frame 26 is fully in the upright configuration, the inner edge of the first support arch 32A is selectively secured to the outer edge of the second support arch 32B and the outer edge of the fourth support arch 32D (i.e. the first support arch 32A is effectively positioned outside the second support arch 32B and the fourth support arch 32D); the outer edge of the second support arch 32B is selectively secured to the inner edge of the first support arch 32A, and the inner edge of the second support arch 32B is selectively secured to the outer edge of the third support arch 32C (i.e. the second support arch 32B is effectively positioned inside the first support arch 32A and outside the third support arch 32C); the outer edge of the third support arch 32C is selectively secured to the inner edge of the second support arch 32B, and the inner edge of the third support arch 32C is selectively secured to the outer edge of the fourth support arch 32D (i.e. the third support arch 32C is effectively positioned inside the second support arch 32B and outside the fourth support arch 32D); and the outer edge of the fourth support arch 32D is selectively secured to the inner edge of the third support arch 32C and the first support arch 32A (i.e. the fourth support arch 32D is effectively positioned inside the third support arch 32C and the first support arch 32A).

With the design of the enclosure frame 26, as described herein, the support arches 32A-32D are better able to share the load of impact if and when a user of the trampoline assembly 10 contacts the enclosure 28 (illustrated in FIG. 1) during use of the trampoline assembly 10.

Figure 3:
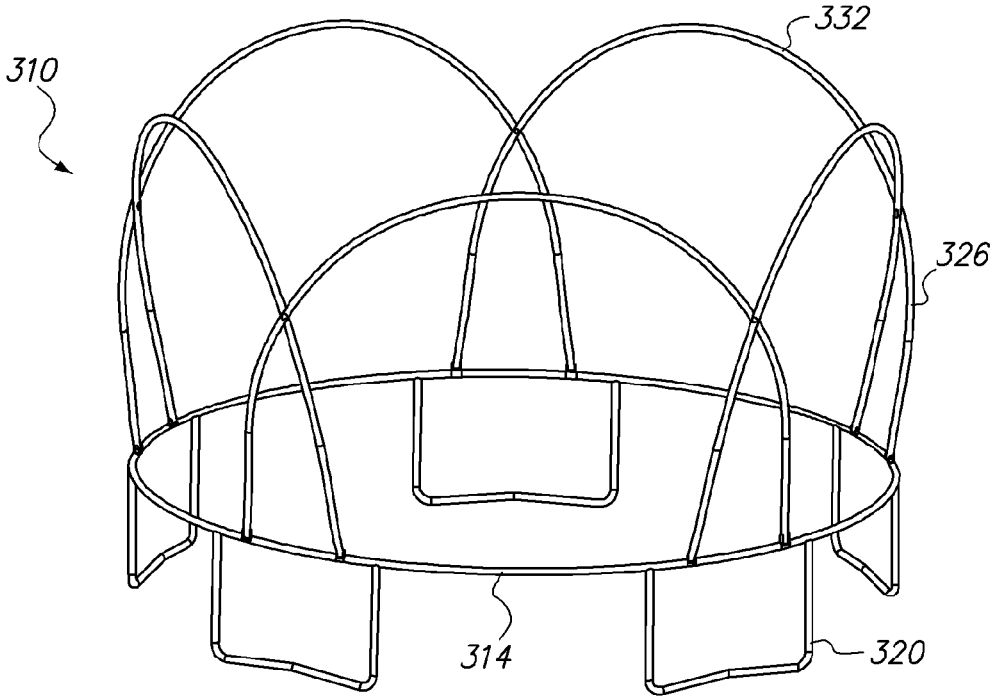
FIG. 3 is a simplified perspective view of a portion of another embodiment of a trampoline assembly having features of the present invention.

FIG. 3 is a simplified perspective view of a portion of another embodiment of a trampoline assembly 310 having features of the present invention. In particular, FIG. 3 illustrates a base frame 314, a plurality of legs 320, and an enclosure frame 326 that are substantially similar to the base frame 14, the plurality of legs 20 and the enclosure frame 26 illustrated and described above in relation to FIG. 1. However, in this embodiment, the base frame 314 can be approximately fourteen feet in diameter and the trampoline assembly 310 includes five legs 320 that are spaced apart around the base frame 314, so as to maintain the base frame 314 and the bed 12 (illustrated in FIG. 1) above the support surface 24 (illustrated in FIG. 1). Additionally, in this embodiment, the enclosure frame 326 includes five support arches 332 that are removably and hingably connected to the base frame 314 and extend upward away from the base frame 314, and that cooperate to extend fully around the perimeter of the base frame 314.

Figure 4:
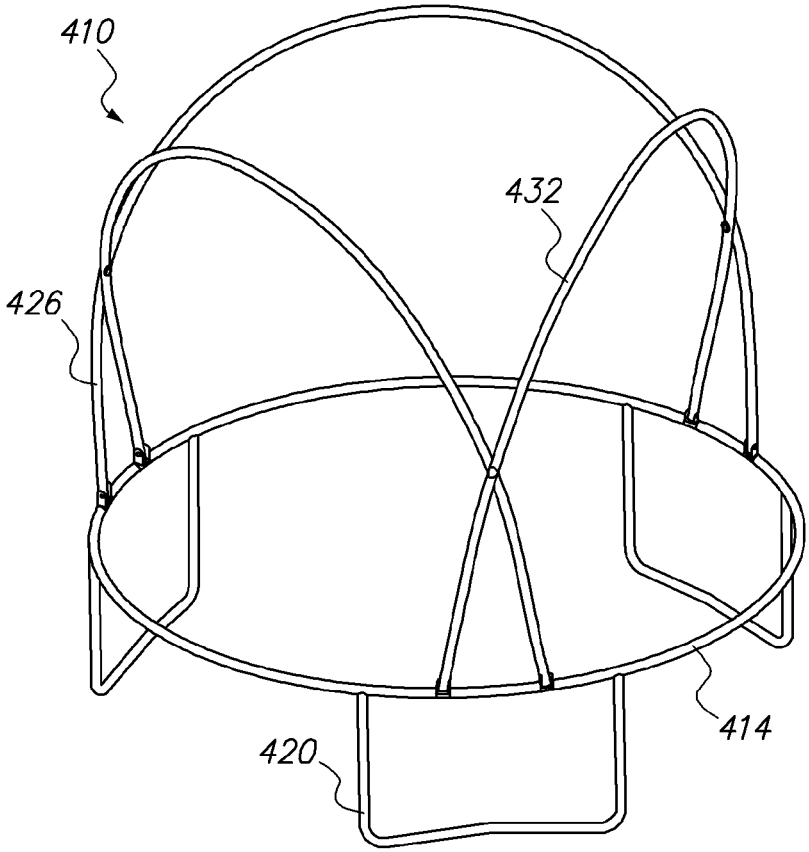
FIG. 4 is a simplified perspective view of a portion of still another embodiment of a trampoline assembly having features of the present invention.

FIG. 4 is a simplified perspective view of a portion of still another embodiment of a trampoline assembly 410 having features of the present invention. In particular, FIG. 4 illustrates a base frame 414, a plurality of legs 420, and an enclosure frame 426 that are substantially similar to the base frame 14, the plurality of legs 20 and the enclosure frame 26 illustrated and described above in relation to FIG. 1. However, in this embodiment, the base frame 414 can be approximately eight feet in diameter and the trampoline assembly 410 includes three legs 420 that are spaced apart around the base frame 414, so as to maintain the base frame 414 and the bed 12 (illustrated in FIG. 1) above the support surface 24 (illustrated in FIG. 1). Additionally, in this embodiment, the enclosure frame 426 includes three support arches 432 that are removably and hingably connected to the base frame 414 and extend upward away from the base frame 414, and that cooperate to extend fully around the perimeter of the base frame 414.

Figure 5A:
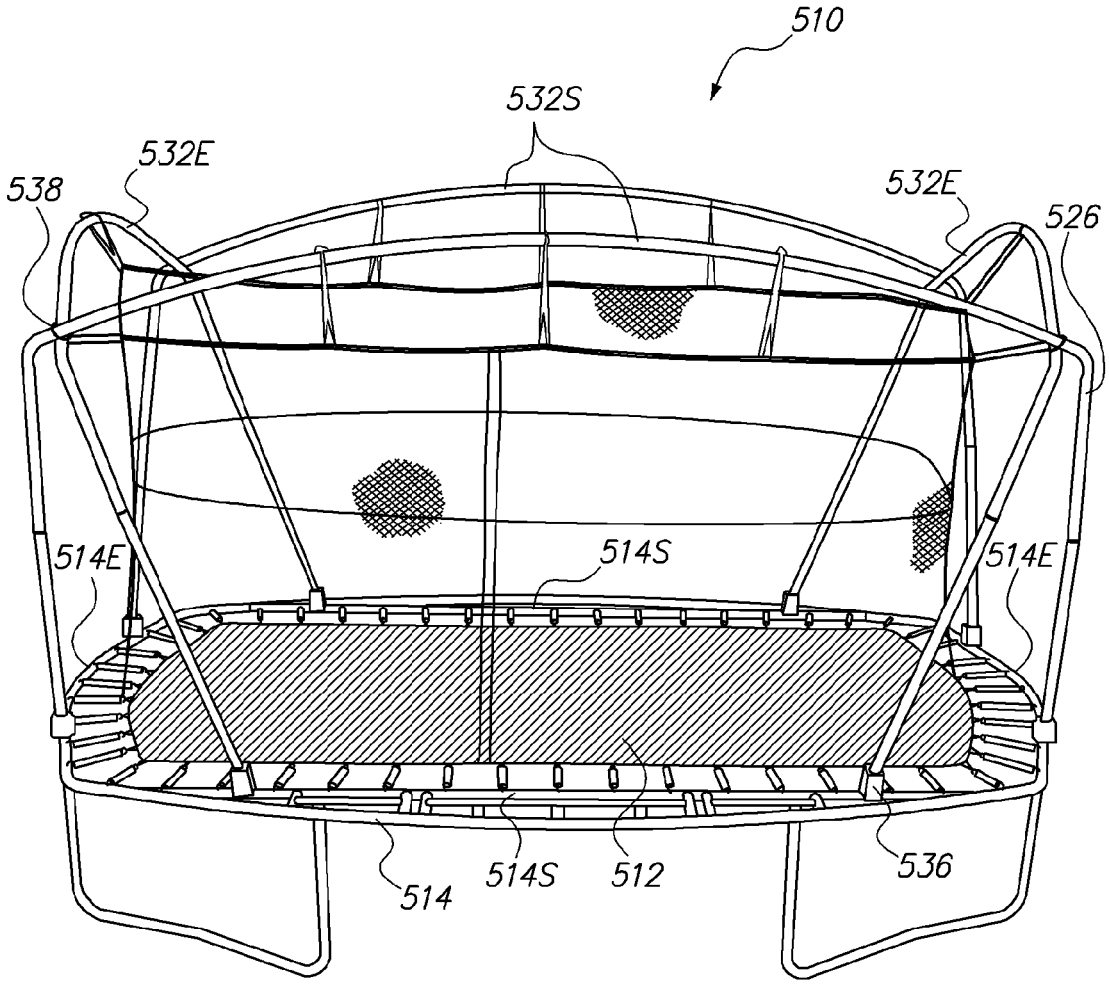
FIG. 5A is a simplified perspective view of yet another embodiment of a trampoline assembly, wherein the enclosure frame is positioned in the upright configuration.

FIG. 5A is a simplified perspective view of yet another embodiment of a trampoline assembly 510, wherein the enclosure frame 526 is positioned in the upright configuration. As illustrated, the trampoline assembly 510 is somewhat similar to the trampoline assemblies illustrated and described herein above. However, in this embodiment, the trampoline assembly 510 includes a base frame 514 and a bed 512 that are substantially rectangle shaped. More particularly, the base frame 514 includes a pair of opposed frame sides 514S and a pair of opposed frame ends 514E.

Additionally, as illustrated, the enclosure frame 526 includes a pair of side support arches 532S that extend substantially parallel to the frame sides 514S and a pair of end support arches 532E that extend substantially parallel to the frame ends 514E. Due to the shape of the base frame 514, the side support arches 532S are somewhat larger and span a greater portion of the perimeter of the base frame 514 than the end support arches 532E. However, each of the side arches 532S and each of the end arches 532E are still pivotally connected to the base frame 514 by a pair of base connectors 536. Further, each of the side arches 532S can be connected to each of the end arches 532E by one or more arch connectors 538 so as to maintain the enclosure frame 526 in the upright configuration.

Figure 5B:
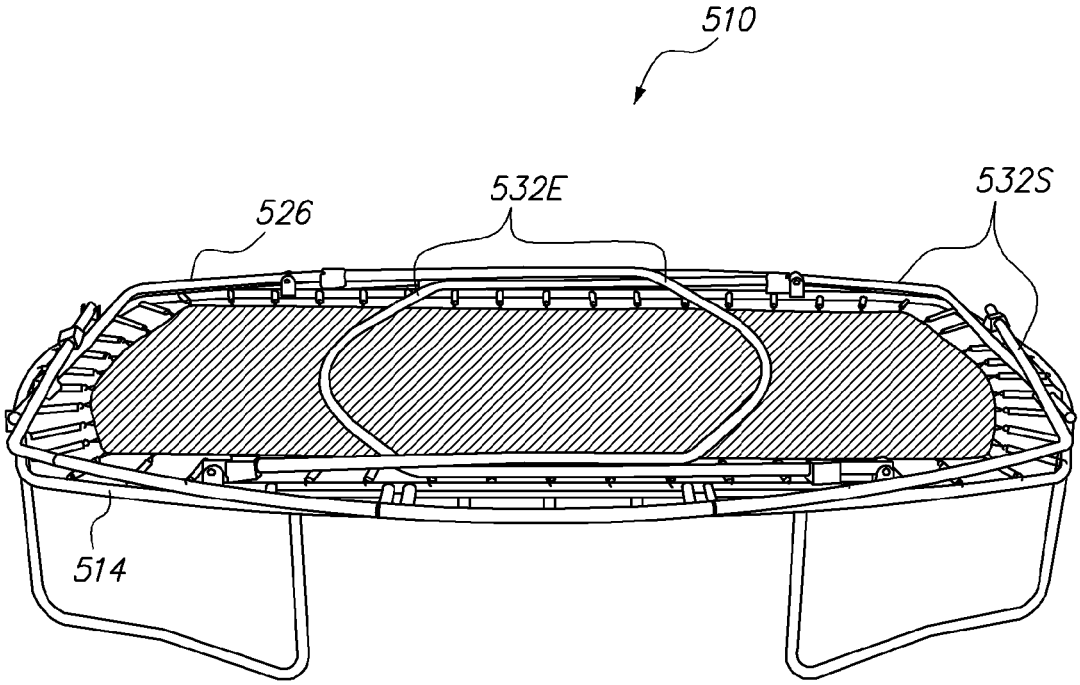
FIG. 5B is a simplified perspective view of the trampoline assembly illustrated in FIG. 5A, wherein the enclosure frame is positioned in the collapsed configuration.

FIG. 5B is a simplified perspective view of the trampoline assembly 510 illustrated in FIG. 5A, wherein the enclosure frame 526 is positioned in the collapsed configuration. In particular, in FIG. 5B, the arch connectors 538 have been removed so that the side arches 532S and the end arches 532E can be and has been pivoted relative to the base frame 514 so that the enclosure frame 526 is in the collapsed configuration.

Figure 6A:
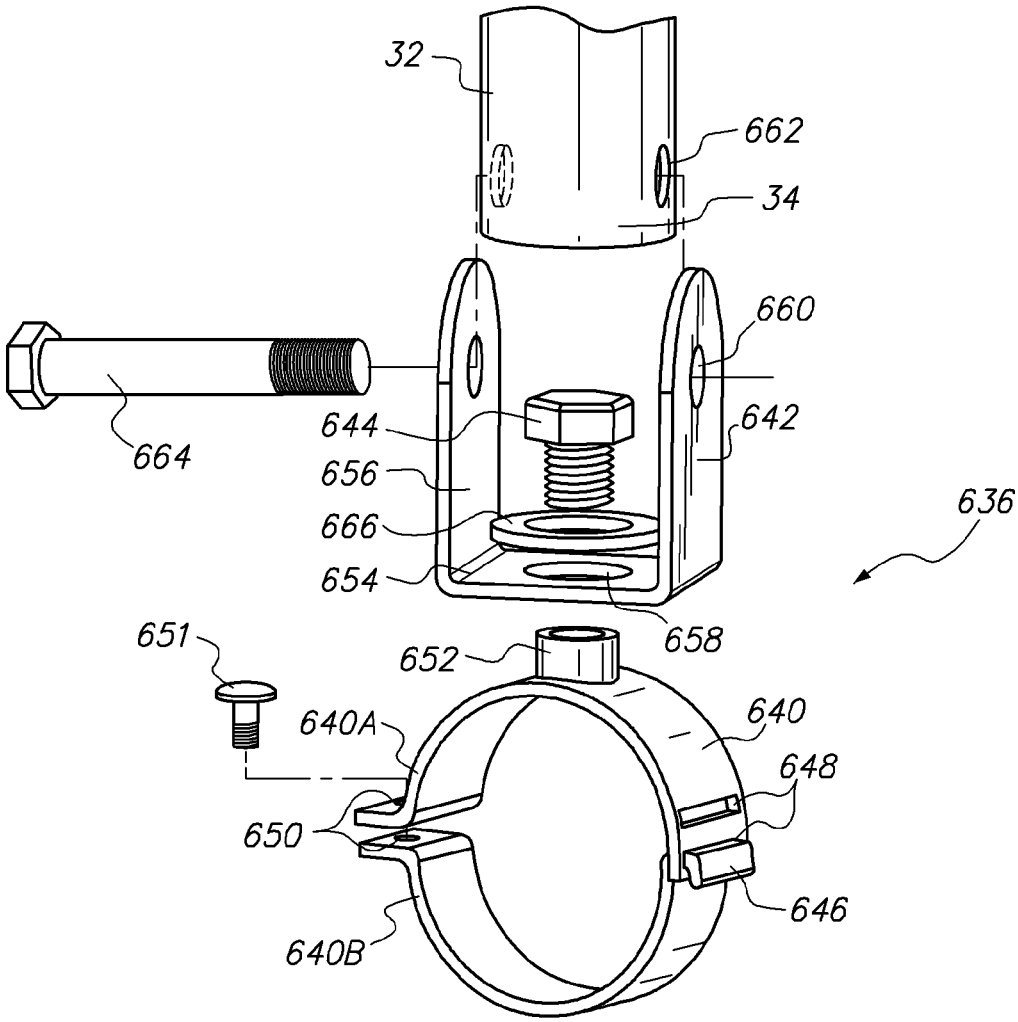
FIG. 6A is an exploded perspective view of an embodiment of a base connector usable with a trampoline assembly having features of the present invention.

FIG. 6A is an exploded perspective view of an embodiment of a base connector 636 usable with a trampoline assembly having features of the present invention. In particular, the base connector 636 can be used with any of the trampoline assemblies 10, 310, 410, 510 illustrated and described above in relation to FIGS. 1, 3, 4 and 5A, respectively.

As provided above, the base connector 636 connects one of the support arch ends 34 of one of the support arches 32 to the base frame 14 (illustrated in FIG. 1). The design of the base connector 636 can be varied depending on the specific requirements of the trampoline assembly 10 (illustrated in FIG. 1) and/or the support arches 32. In this embodiment, the base connector 636 includes a collar 640, a connector base 642, and a connector attacher 644.

The collar 640 is adapted to be selectively secured to the base frame 14. The design of the collar 640 can be varied depending on the requirements of the base connector 636. In this embodiment, the collar 640 is substantially ring shaped and is adapted to substantially encircle the base frame 14. Further, as shown, the collar 640 can be made from two semi-circular collar members 640A, 640B that are selectively connected together to effectively position the collar 640 about the base frame 14. More particularly, in this embodiment, one of the collar members 640A, 640B includes a hook portion 646 and the other collar member 640A, 640B includes one or more slots 648 that are adapted to alternatively receive the hook portion 646 so that the collar 640 can be properly sized as the collar 640 is positioned about the base frame 14. Additionally, as illustrated, each collar member 640A, 640B can include a pin aperture 650 that are positioned substantially adjacent to one another when the collar 640 is positioned about the base frame 14, and that are adapted to receive a collar pin 651, e.g., a screw, to secure the collar members 640A, 640B together about the base frame 14. With this design, the collar 640 can be quickly and easily connected to and removed from the base frame 14.

Additionally, as shown in the embodiment illustrated in FIG. 6A, the collar 640 further includes a connector receiver 652 that is adapted to receive the connector attacher 644. In this embodiment, the connector receiver 652 is substantially circular in shape and protrudes from the outer surface of the collar 640 and is internally threaded so as to effectively receive the connector attacher 644. Alternatively, the connector receiver 652 can have a different shape and/or a different design. When in use, the connector receiver 652 is positioned substantially directly above the base frame 14 in order to receive the connector attacher 644.

The connector base 642 is adapted to be secured to the collar 640. As illustrated in FIG. 6A, the connector base 642 can be somewhat U-shaped and includes a connector bottom 654 and a pair of spaced apart connector sides 656. The connector bottom 654 further includes an attacher aperture 658. As illustrated in this embodiment, the attacher aperture 658 is substantially circular in shape and the connector receiver 652 can extend through the attacher aperture 658. Additionally, the connector attacher 644 includes a threaded portion that is adapted to extend into and threadedly engage the connector receiver 652 to secure the connector base 642 to the collar 640. In one non-exclusive alternative embodiment, the base connector 636 can be designed without the collar 640, and the connector base 642 can be directly connected to the base frame 14. In such embodiment, the connector attacher 644 can extend through the attacher aperture 658 and through a frame aperture that extends substantially vertically through the base frame 14.

Further, as illustrated in FIG. 6A, each of the connector sides 656 can include an arch aperture 660. Additionally, the support arches 32 can include an end aperture 662 positioned near each support arch end 34 of the support arch 32. The end aperture 662 is adapted to be positioned in alignment with the arch apertures 660, such that a connector pin 664, e.g., a bolt or a screw, can extend through each of the arch apertures 660 and the end aperture 662. With this design, the support arches 32 can be sturdily maintained in a coupled relationship with the base frame 14 via the base connector 636. Additionally, this design allows the support arches 32 to rotate and/or pivot relative to the connector base 642, thereby enabling the support arches 32 to be selectively moved between the upright configuration and the collapsed configuration.

In one non-exclusive alternative embodiment, each of the support arches 32 can include two pairs of connector pins, e.g., detent buttons, such that one pair of connector pins are positioned substantially adjacent to and cantilever laterally away from each of the support arch ends 34. Each of the connector pins is adapted to be positioned within and/or extend through one of the arch apertures 660. Further, each of the connector pins is biased to be in an extended position such that the connector pins can be effectively maintained within the arch apertures 660 to maintain the support arches 32 in a coupled relationship with the base frame 14 via the base connector 636. Moreover, each of the connector pins can be depressed to enable the connector pins to be quickly and easily positioned within and/or removed from the arch apertures 660.

As provided above, the connector attacher 644 is adapted to extend through the attacher aperture 658 and into the connector receiver 652 to secure the connector base 642 to the collar 640. In one embodiment, the connector attacher 644 is a screw that is externally threaded so as to be effectively screwed into the connector receiver 652. Alternatively, the connector attacher 644 can have a different design. Further, in one embodiment, as illustrated, a washer 666 can be positioned between connector attacher 644 and the connector bottom 654 of the connector base 642.

Figure 6B:
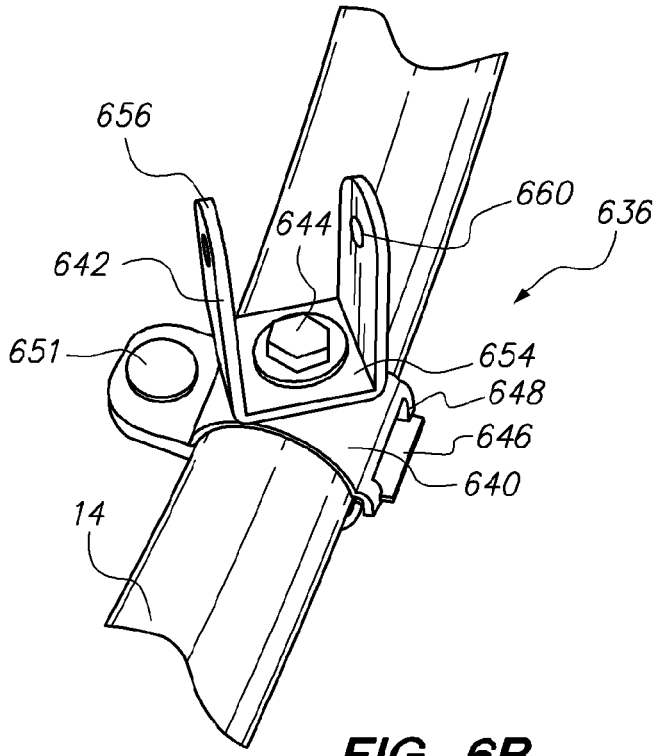
FIG. 6B is a perspective view of the base connector illustrated in FIG. 6A that is mounted on the base frame.

FIG. 6B is a perspective view of the base connector 636 illustrated in FIG. 6A that is connected to or mounted on the base frame 14. As illustrated, when the base connector 636 is connected to the base frame 14, the collar 640 substantially encircles the base frame 14. More particularly, the hook portion 646 engages one of the one or more slots 648, and the collar pin 651 extends through the pin apertures 650 (illustrated in FIG. 6A) to secure the collar 640 of the base connector 636 to the base frame 14.

Additionally, the connector base 642 is secured to the collar 640 by the connector attacher 644 as the connector attacher 644 extends through the attacher aperture 658 (illustrated in FIG. 6A). As shown in FIG. 6B, when the connector base 642 is secured to the collar 640, the connector base 642 is positioned substantially directly above the base frame 14 and the connector sides 656 extend in a generally upward direction away from the connector bottom 654, the collar 640 and the base frame 14. In this position, the arch apertures 660 are positioned to receive the connector pin 664 (illustrated in FIG. 6A) that is adapted to extend through the arch apertures 660 and the end aperture 662 (illustrated in FIG. 6A) that are positioned near each support arch end 34 (illustrated in FIG. 1) of the support arch 32 (illustrated in FIG. 1).

Figure 7A:
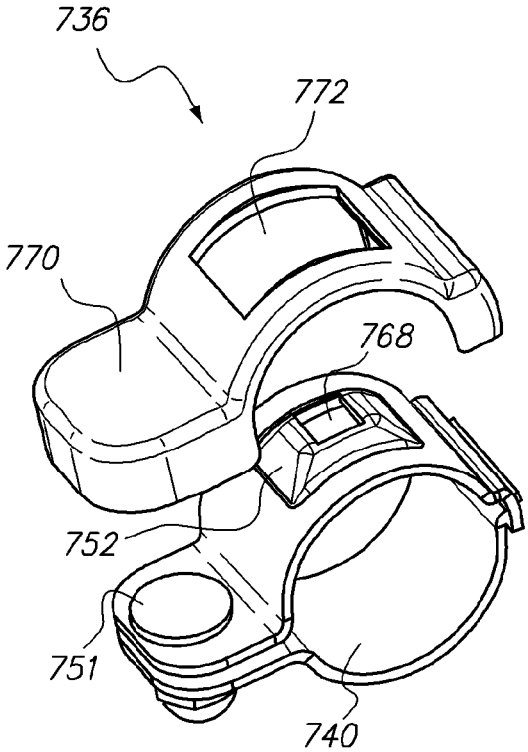
FIG. 7A is a partially exploded perspective view of another embodiment of a base connector usable with the present invention.

FIG. 7A is a partially exploded perspective view of another embodiment of a base connector 736 usable with the present invention. As illustrated, the base connector 736 is somewhat similar to the base connector 636 illustrated and described above in relation to FIG. 6A. However, in this embodiment, the connector receiver 752 is rectangle shaped and includes a substantially square shaped receiver aperture 768 that is adapted to receive the connector attacher 644 (illustrated in FIG. 6A). Moreover, as illustrated in FIG. 7A, the base connector 736 further includes a connector cap 770 that can be positioned substantially above and adjacent to the collar 740 when the base connector 736 is fitted about the base frame 14 (illustrated in FIG. 1). The connector cap 770 includes a cap aperture 772 that is sized and shaped to fit about the connector receiver 752.

Figure 7B:
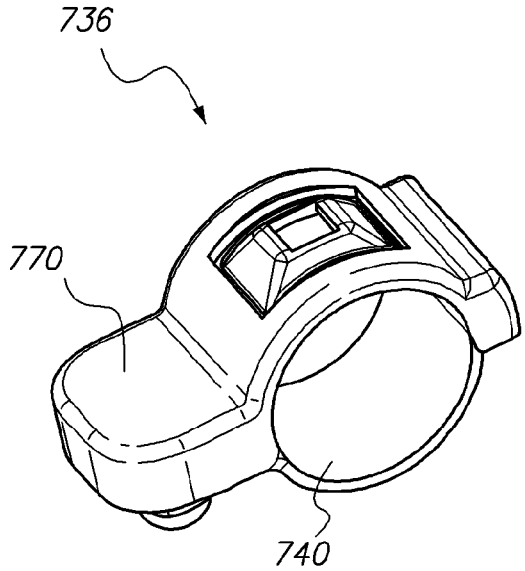
FIG. 7B is a perspective view of the base connector illustrated in FIG. 7A.

FIG. 7B is a perspective view of the base connector 736 illustrated in FIG. 7A. In particular, FIG. 7B illustrates the base connector 736 with the connector cap 770 positioned substantially above an adjacent to the collar 740 so that the base connector 736 can be more securely connected to the base frame 14 (illustrated in FIG. 1) and to otherwise inhibit contact between the user and the collar 740 and the collar pin 751 (illustrated in FIG. 7A).

Figure 8:
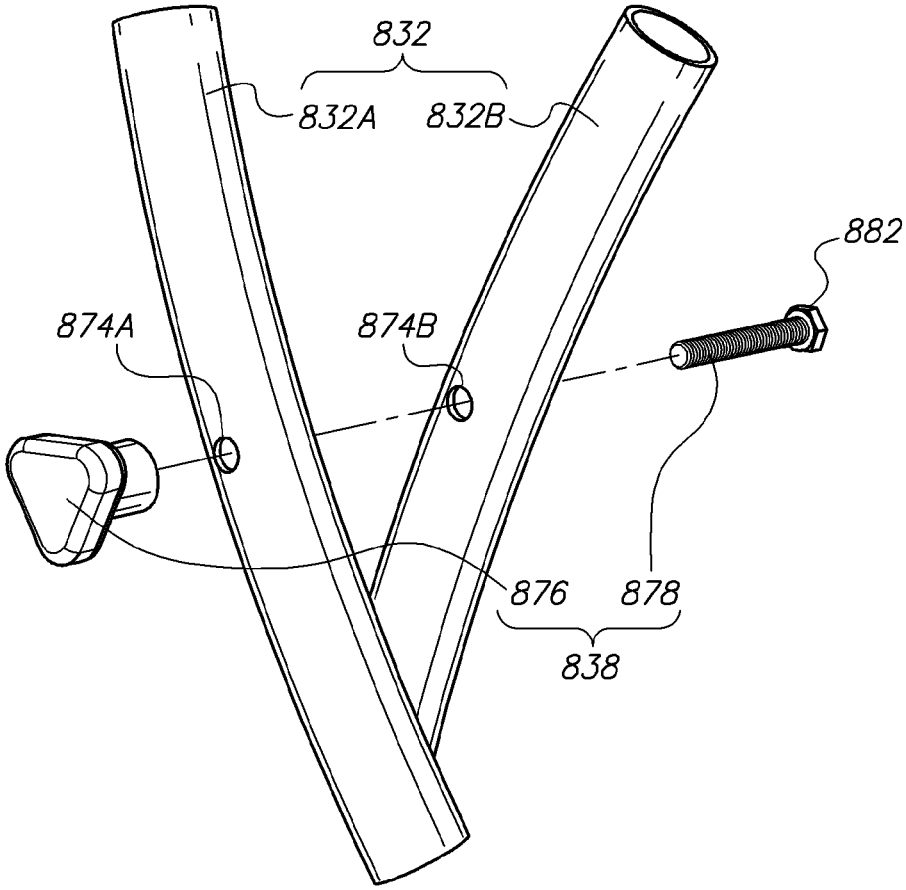
FIG. 8 is an exploded perspective view of a portion of a pair of support arches and an embodiment of an arch connector usable with a trampoline assembly having features of the present invention.

FIG. 8 is an exploded perspective view of a portion of a pair of support arches 832 and an embodiment of an arch connector 838 usable with a trampoline assembly having features of the present invention. In particular, the arch connector 838 can be used to connect the pair of support arches 832, e.g., a first support arch 832A and a second support arch 832B, in any of the trampoline assemblies 10, 310, 410, 510 illustrated and described above in relation to FIGS. 1, 3, 4 and 5A, respectively.

The design of the support arches 832A, 832B and the design of the arch connector 838 can be varied.

In the embodiment illustrated in FIG. 8, the first support arch 832A includes a first connector aperture 874A that is adapted to receive a portion of the arch connector 838. Somewhat similarly, the second support arch 832B includes a second connector aperture 874B that is designed to be substantially aligned with the first connector aperture 874A and is adapted to receive a portion of the arch connector 838.

Additionally, in this embodiment, the arch connector 838 includes a connector head 876 and a connector body 878. The connector head 876 is adapted to selectively engage the connector body 878 so as to secure the first support arch 832A to the second support arch 832B. More particularly, in the embodiment illustrated in FIG. 8, the connector head 876 includes a head aperture (not illustrated) that is internally threaded and that is sized and shaped to threadedly receive a portion of the connector body 878. The connector body 878, e.g., a screw, is adapted to extend through the first connector aperture 874A and the second connector aperture 874B and be screwed into the head aperture of the connector head 876. Further, the connector body 878 includes a body end 882, e.g., a nut, that inhibits the connector body 878 from being removed from the first connector aperture 874A and the second connector aperture 874B when the connector head 876 is selectively engaging the connector body 878. Alternatively, the arch connector 838 can have a different design.

Further, as illustrated, in one embodiment, the connector head 876 can be substantially triangle shaped so as to enable the user to more easily grip and rotate, i.e. to tighten and/or loosen, the connector head 876 relative to the connector body 878. Alternatively, the connector head 876 can have a different shape.

Figure 9A:
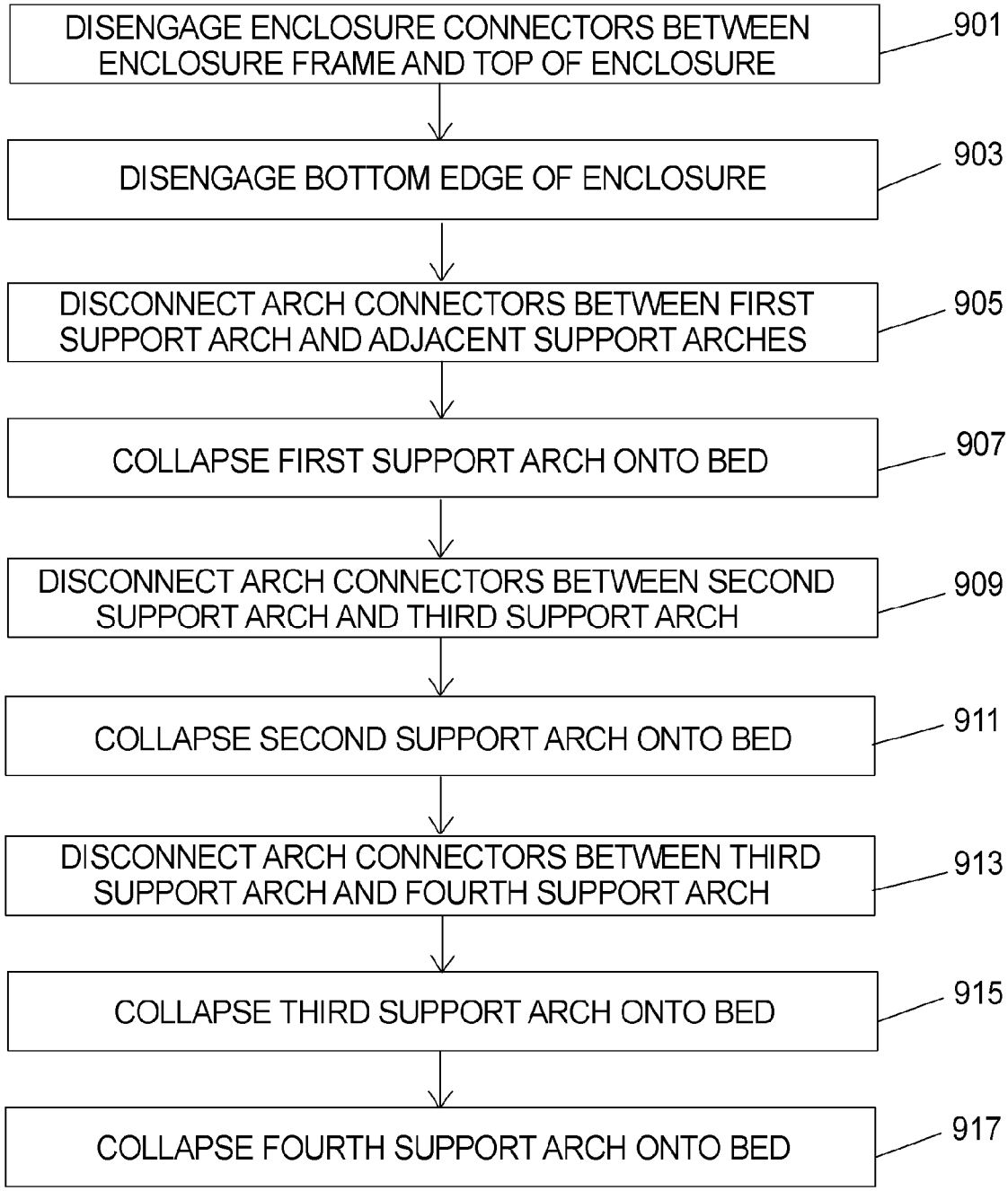
FIG. 9A is a simplified flowchart illustrating the movement of the enclosure assembly from the working configuration to the non-working configuration.

FIG. 9A is a simplified flowchart illustrating the movement of the enclosure assembly from the working configuration to the non-working configuration. When moving the enclosure assembly from the working configuration to the non-working configuration, initially, in step 901, each of the enclosure connectors that extend between the enclosure frame and the enclosure is disengaged from the enclosure frame and/or from the top edge of the enclosure. Next, in step 903, the bottom edge of the enclosure is disengaged from the base frame, the cover, the bed and/or the plurality of resilient members.

Subsequently, in step 905, the arch connectors that are utilized to connect the first support arch and the adjacent support arches, e.g., the second support arch and the fourth support arch, are disconnected so that the first support arch is no longer connected to any of the other support arches. Then, in step 907, the first support arch is folded down or collapsed onto the bed of the trampoline assembly.

Next, in step 909, the arch connector that is utilized to connect the second support arch and the third support arch is disconnected so that the second support arch is no longer connected to any of the other support arches. Then, in step 911, the second support arch is folded down or collapsed onto the bed of the trampoline assembly.

Subsequently, in step 913, the arch connector that is utilized to connect the third support arch and the fourth support arch is disconnected so that the third support arch is no longer connected to any of the other support arches. Then, in step 915, the third support arch is folded down or collapsed onto the bed of the trampoline assembly.

Finally, in step 917, the fourth support arch is folded down or collapsed onto the bed of the trampoline assembly. At this point, the enclosure assembly is fully in the non-working configuration and each of the support arches are folded down or collapsed substantially adjacent to one another onto the bed of the trampoline assembly.

Figure 9B:
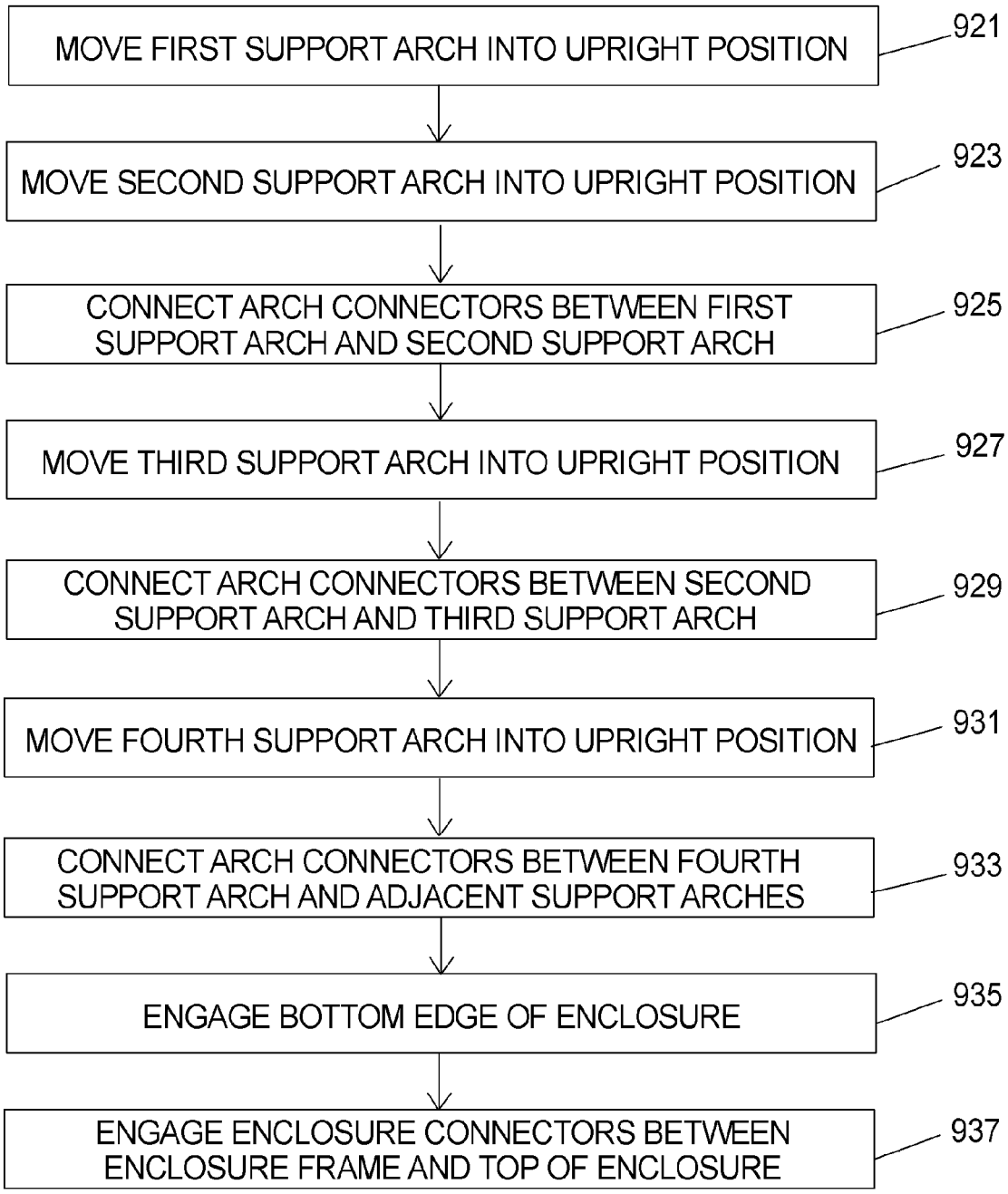
FIG. 9B is a simplified flowchart illustrating the movement of the enclosure assembly from the non-working configuration to the working configuration.

FIG. 9B is a simplified flowchart illustrating the movement of the enclosure assembly from the non-working configuration to the working configuration. When moving the enclosure assembly from the non-working configuration to the working configuration, initially, in step 921, the first support arch is rotated relative to the base frame so that the first support arch is in the upright position. Next, in step 923, the second support arch is rotated relative to the base frame so that the second support arch is in the upright position substantially adjacent to the first support arch. Then, in step 925, an arch connector is utilized to connect the first support arch and the second support arch. This enables the first support arch and the second support arch to be maintained substantially adjacent to one another in the upright position.

Subsequently, in step 927, the third support arch is rotated relative to the base frame so that the third support arch is in the upright position substantially adjacent to the second support arch. Then, in step 929, an arch connector is utilized to connect the second support arch and the third support arch. This enables the first support arch, the second support arch and the third support arch to be maintained substantially adjacent to one another in the upright position.

Next, in step 931, the fourth support arch is rotated relative to the base frame so that the fourth support arch is in the upright position substantially adjacent to the first support arch and the third support arch. Then, in step 933, an arch connector is utilized to connect the third support arch and the fourth support arch, and an arch connector is utilized to connect the first support arch and the fourth support arch. This enables the first support arch, the second support arch, the third support arch and the fourth support arch to be maintained substantially adjacent to one another in the upright position.

Subsequently, in step 935, the bottom edge of the enclosure is engaged with the base frame, the cover, the bed and/or the plurality of resilient members. Finally, in step 937, enclosure connectors are extended between the enclosure frame and the enclosure to connect and/or engage the enclosure frame with the top edge of the enclosure. At this point, the enclosure assembly is fully in the working configuration and the trampoline assembly is ready to be used by one or more users.

It should be noted that some of the steps as described herein can be combined or eliminated, further steps can be added, and/or the order of some of the steps can be altered without otherwise changing the purpose and/or results of the above-recited processes.

Figure 10A:
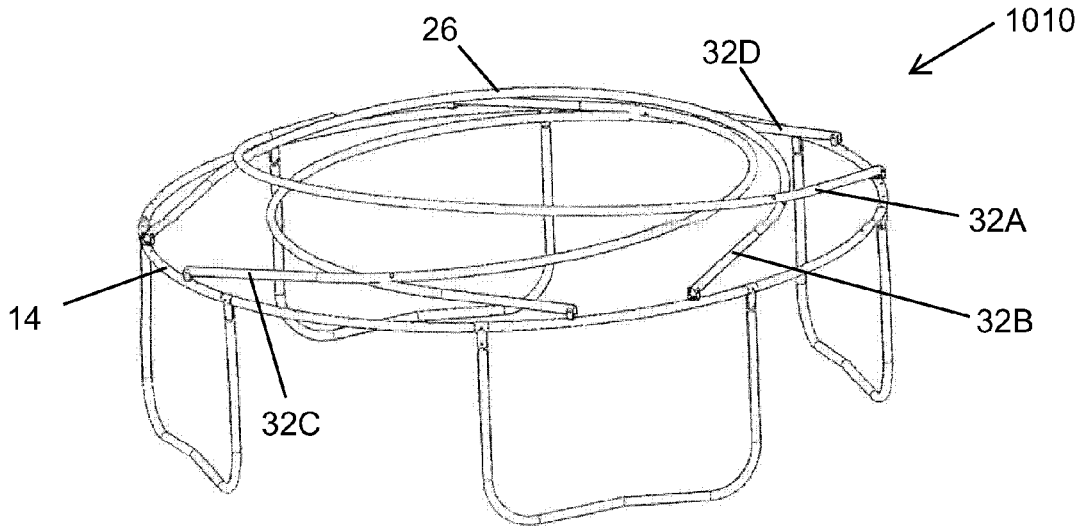
FIG. 10A is a simplified perspective view of a portion of still yet another embodiment of a trampoline assembly, wherein the enclosure frame is positioned in the collapsed configuration.
Figure 10B:
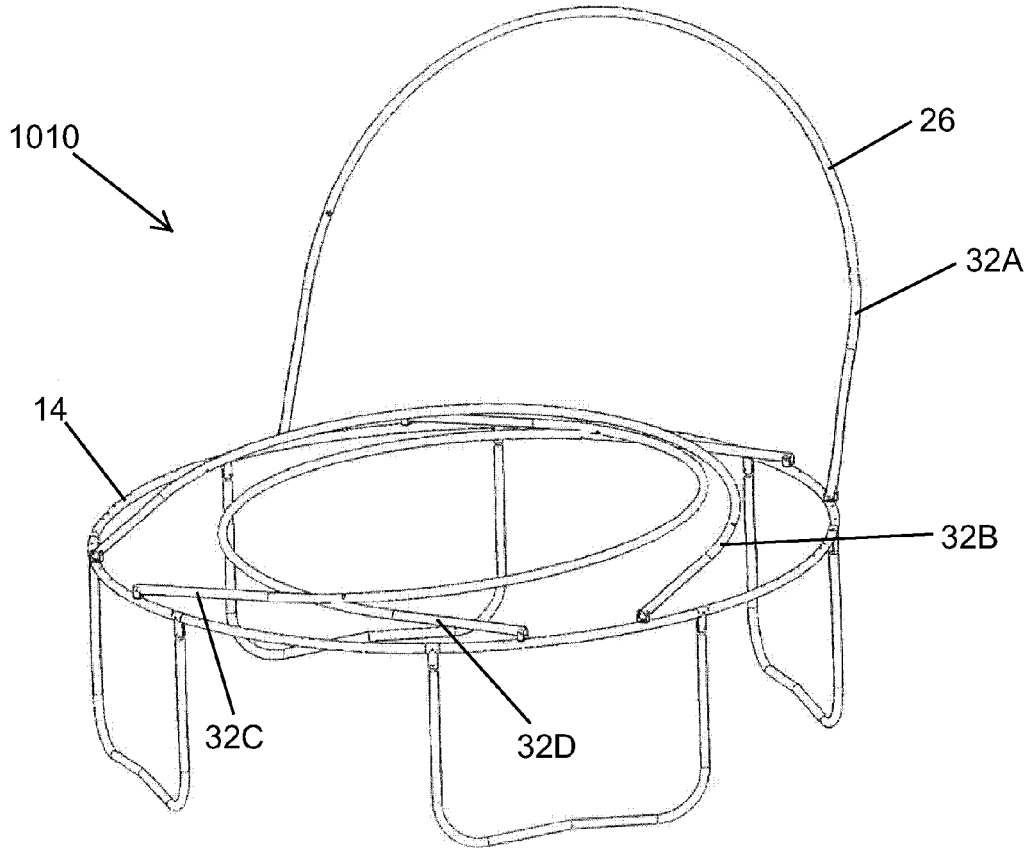
FIG. 10B is a simplified perspective view of a portion of the trampoline assembly illustrated in FIG. 10A, wherein the enclosure frame is moved partially toward the upright configuration.
Figure 10C:
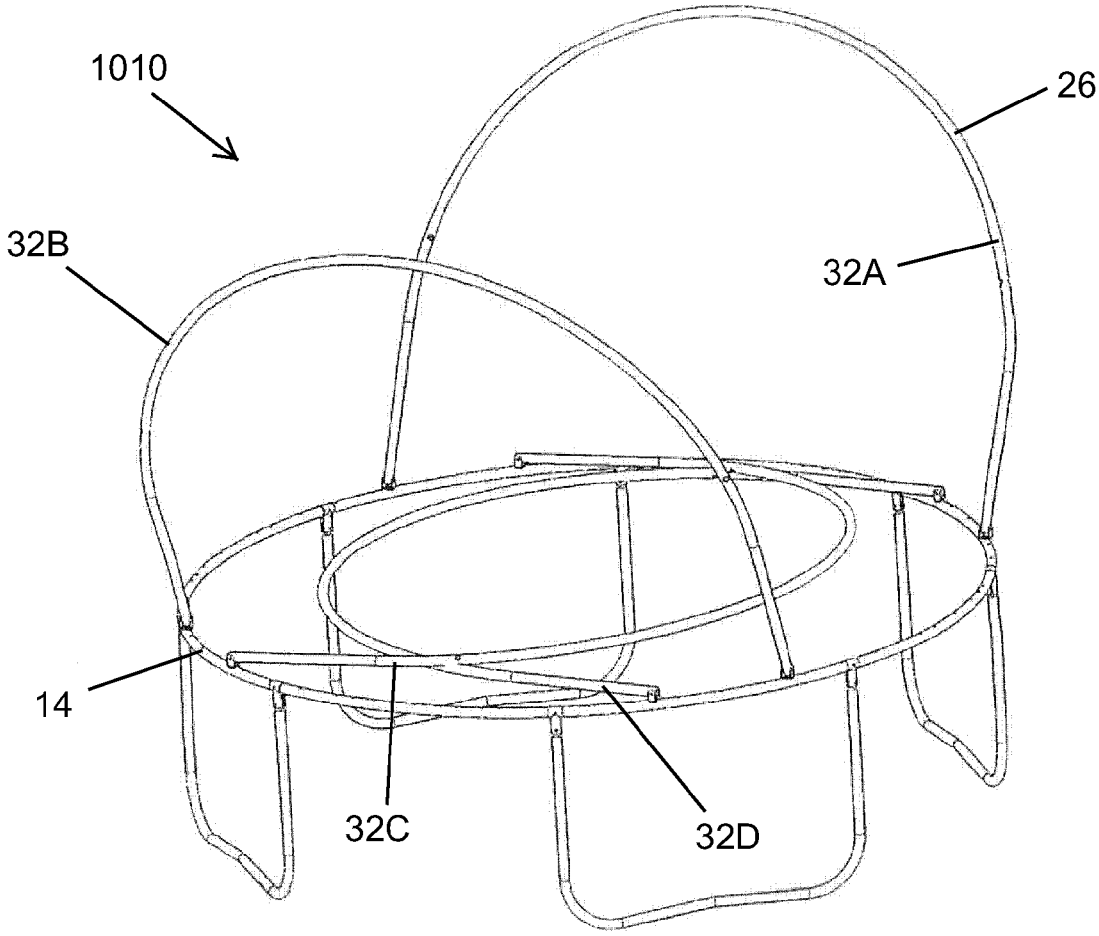
FIG. 10C is a simplified perspective view of a portion of the trampoline assembly illustrated in FIG. 10A, wherein the enclosure frame is moved further toward the upright configuration.
Figure 10D:
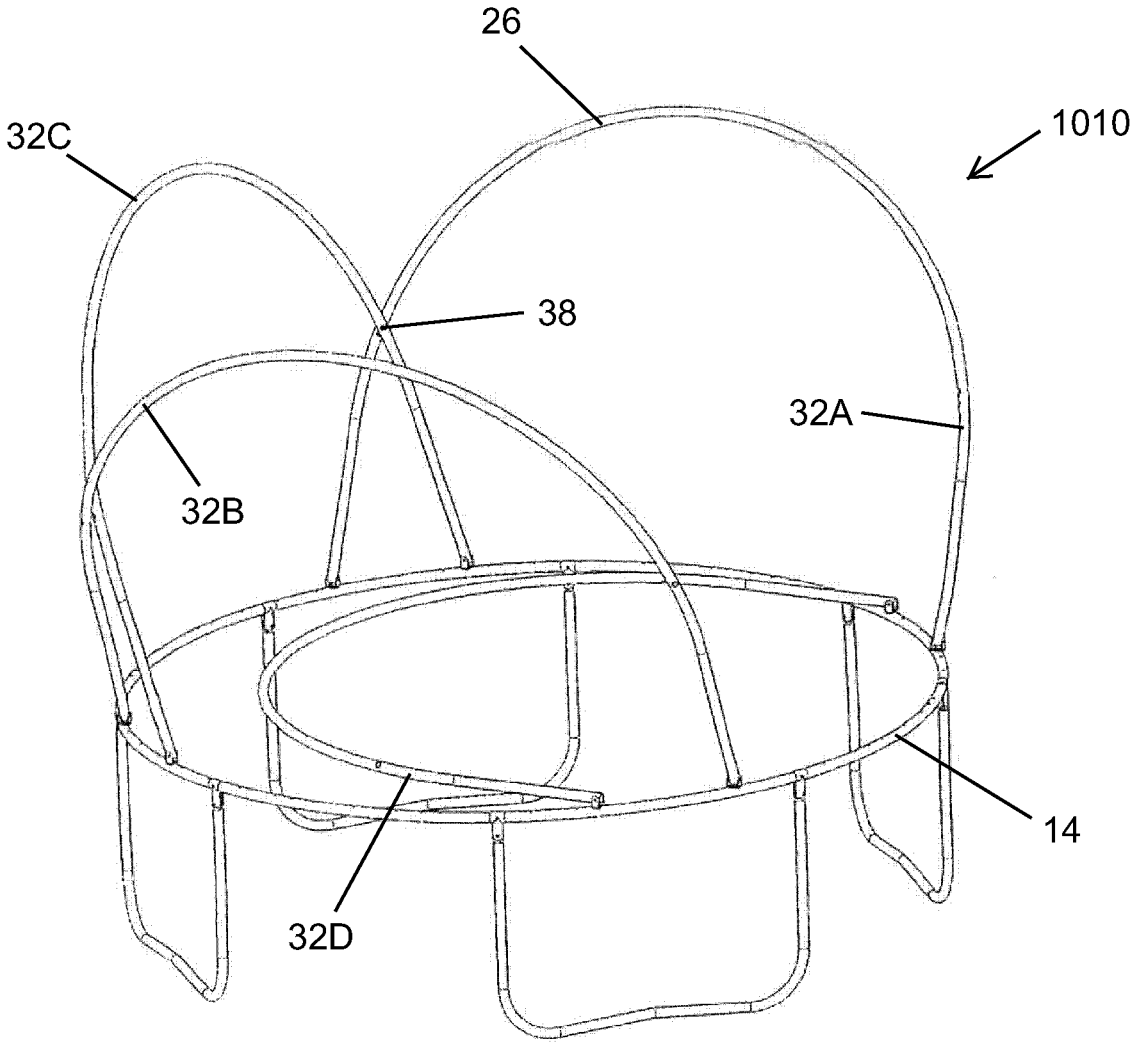
FIG. 10D is a simplified perspective view of a portion of the trampoline assembly illustrated in FIG. 10A, wherein the enclosure frame is moved still further toward the upright configuration.
Figure 10E:
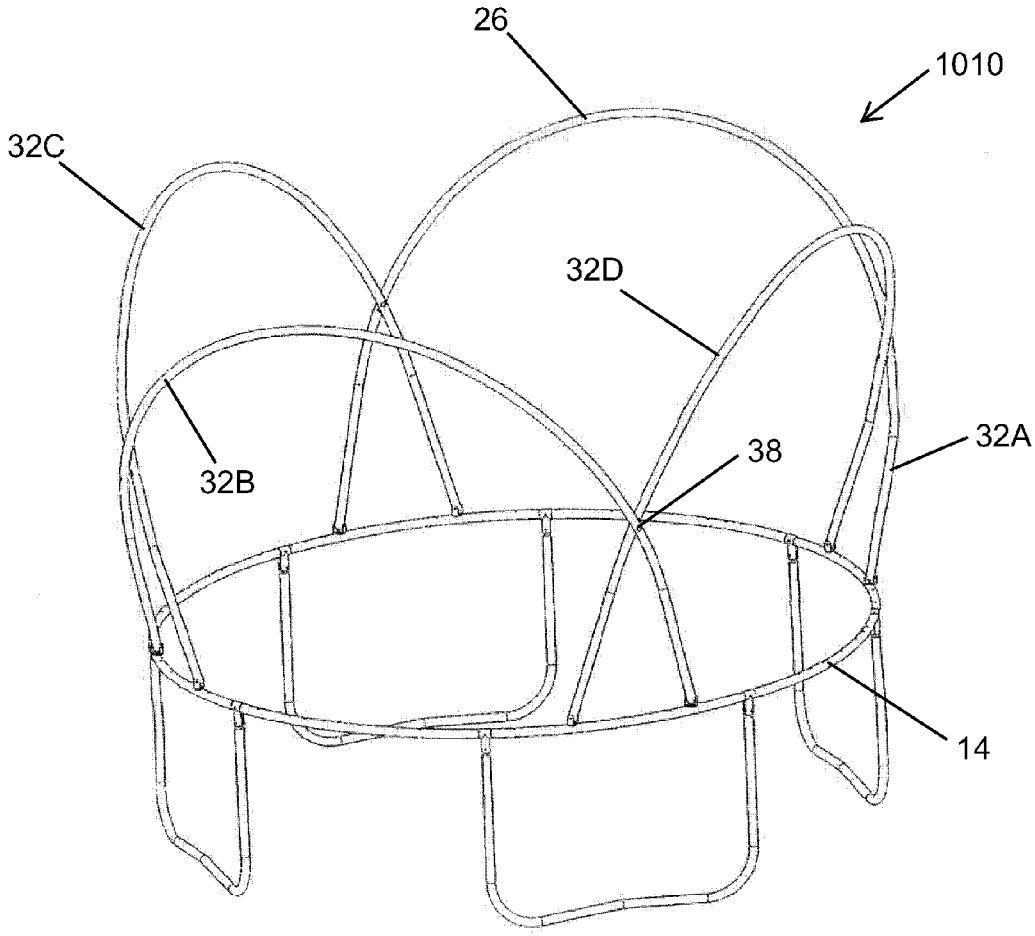
FIG. 10E is a simplified perspective view of a portion of the trampoline assembly illustrated in FIG. 10A, wherein the enclosure frame is positioned in the upright configuration

FIGS. 10A-10E illustrate another non-exclusive example of the gradual movement of the enclosure frame 26 from the collapsed configuration (illustrated in FIG. 10A) to the upright configuration (illustrated in FIG. 10E). In particular, FIG. 10A is a simplified perspective view of a portion of still yet another embodiment of a trampoline assembly 1010, wherein the enclosure frame 26 is positioned fully in the collapsed configuration; FIG. 10B is a simplified perspective view of a portion of the trampoline assembly 1010 illustrated in FIG. 10A, wherein the enclosure frame 26 is moved partially toward the upright configuration; FIG. 100 is a simplified perspective view of a portion of the trampoline assembly 1010 illustrated in FIG. 10A, wherein the enclosure frame 26 is moved further toward the upright configuration; FIG. 10D is a simplified perspective view of a portion of the trampoline assembly 1010 illustrated in FIG. 10A, wherein the enclosure frame 26 is moved still further toward the upright configuration; and FIG. 10E is a simplified perspective view of a portion of the trampoline assembly 1010 illustrated in FIG. 10A, wherein the enclosure frame 26 is positioned fully in the upright configuration.

In FIG. 10A, each of the first support arch 32A, the second support arch 32B, the third support arch 32C, and the fourth support arch 32D are positioned substantially adjacent to one another in a folded down or collapsed position on the bed 12 (illustrated in FIG. 1) of the trampoline assembly 1010. More particularly, as illustrated in FIG. 10A, the enclosure frame 26 is positioned fully in the collapsed configuration, and the trampoline assembly 1010 is protected from unwanted and/or unsupervised use.

Moreover, in this embodiment, when the enclosure frame 26 is in the collapsed configuration, all of the support arches 32A-32D are again positioned substantially within the perimeter of the base frame 14 such that no portion of any of the support arches 32A-32D extends outside the perimeter of the base frame 14.

Additionally, in this embodiment, when the first support arch 32A is in the collapsed configuration, the second support arch 32B, the third support arch 32C and the fourth support arch 32D are inhibited from being moved from the collapsed configuration to the upright configuration.

In FIG. 10B, a portion of the enclosure frame 26, i.e. the first support arch 32A, has been rotated to the upright position and the first support arch 32A is no longer folded down or collapsed on the bed 12 (illustrated in FIG. 1) of the trampoline assembly 1010. Additionally, as illustrated in FIG. 10B, the second support arch 32B, the third support arch 32C and the fourth support arch 32D are still in the folded down or collapsed position on the bed 12 of the trampoline assembly 1010.

Additionally, in this embodiment, when the first support arch 32A is in the upright configuration and the second support arch 32B is in the collapsed configuration, the third support arch 32C and the fourth support arch 32D are inhibited from being moved from the collapsed configuration to the upright configuration.

In FIG. 10C, another portion of the enclosure frame 26, i.e. the second support arch 32B, has been rotated to the upright position and the second support arch 32B is no longer folded down or collapsed on the bed 12 (illustrated in FIG. 1) of the trampoline assembly 1010. Additionally, the second support arch 32B is now positioned substantially directly across from the first support arch 32A in the upright position. Further, as illustrated in FIG. 10C, the third support arch 32C and the fourth support arch 32D are still in the folded down or collapsed position on the bed 12 of the trampoline assembly 1010.

Moreover, in this embodiment, when the first support arch 32A and the second support arch 32B are in the upright configuration, and the third support arch 32C is in the collapsed configuration, the fourth support arch 32D is inhibited from being moved from the collapsed configuration to the upright configuration.

In FIG. 10D, another portion of the enclosure frame 26, i.e. the third support arch 32C, has been rotated to the upright position and the third support arch 32C is no longer folded down or collapsed on the bed 12 (illustrated in FIG. 1) of the trampoline assembly 1010. Additionally, the third support arch 32C is now positioned substantially adjacent to the first support arch 32A and the second support arch 32B in the upright position. Further, as illustrated in FIG. 10D, the fourth support arch 32D is still in the folded down or collapsed position on the bed 12 of the trampoline assembly 1010.

Moreover, as illustrated in FIG. 2D, once the third support arch 32C has been positioned in the upright position substantially adjacent to the first support arch 32A and the second support arch 32B, an arch connector 38 can be utilized to selectively secure the third support arch 32C to each of the first support arch 32A and the second support arch 32B. More particularly, in one embodiment, an arch connector 38 selectively secures the outer edge of the third support arch 32C to the inner edge of the first support arch 32A, and an arch connector 38 selectively secures the outer edge of the third support arch 32C to the inner edge of the second support arch 32B.

Still further, in this embodiment, when the third support arch 32C is in the upright configuration, the first support arch 32A and the second support arch 32B are inhibited from being moved from the upright configuration to the collapsed configuration.

In FIG. 10E, another portion of the enclosure frame 26, i.e. the fourth support arch 32D, has been rotated to the upright position and the fourth support arch 32D is no longer folded down or collapsed on the bed 12 (illustrated in FIG. 1) of the trampoline assembly 1010. Additionally, the fourth support arch 32D is now positioned substantially adjacent to the first support arch 32A and the second support arch 32B in the upright position, and the fourth support arch 32D is positioned substantially directly across from the third support arch 32C.

Further, as illustrated in FIG. 10E, once the fourth support arch 32D has been positioned in the upright position substantially adjacent to the first support arch 32A and the second support arch 32B, an arch connector 38 can be utilized to selectively secure the fourth support arch 32D to each of the first support arch 32A and the second support arch 32B. More particularly, in one embodiment, an arch connector 38 selectively secures the outer edge of the fourth support arch 32D to the inner edge of the first support arch 32A, and an arch connector 38 selectively secures the outer edge of the fourth support arch 32D to the inner edge of the second support arch 32B.

Moreover, in this embodiment, when the fourth support arch 32D is in the upright configuration, the first support arch 32A and the second support arch 32B are inhibited from being moved from the upright configuration to the collapsed configuration.

In summary, in the embodiment illustrated in FIGS. 10A-10E, when the enclosure frame 26 is fully in the upright configuration, the inner edge of the first support arch 32A is selectively secured to the outer edge of the third support arch 32C and the outer edge of the fourth support arch 32D (i.e. the first support arch 32A is effectively positioned outside the third support arch 32C and the fourth support arch 32D); the inner edge of the second support arch 32B is selectively secured to the outer edge of the third support arch 32C and the outer edge of the fourth support arch 32D (i.e. the second support arch 32B is effectively positioned outside the third support arch 32C and the fourth support arch 32D); the outer edge of the third support arch 32C is selectively secured to the inner edge of the first support arch 32A and the inner edge of the second support arch 32B (i.e. the third support arch 32C is effectively positioned inside the first support arch 32A and the second support arch 32B); and the outer edge of the fourth support arch 32D is selectively secured to the inner edge of the first support arch 32A and the inner edge of the second support arch 32B (i.e. the fourth support arch 32D is effectively positioned inside the first support arch 32A and the second support arch 32B).

Figure 11:
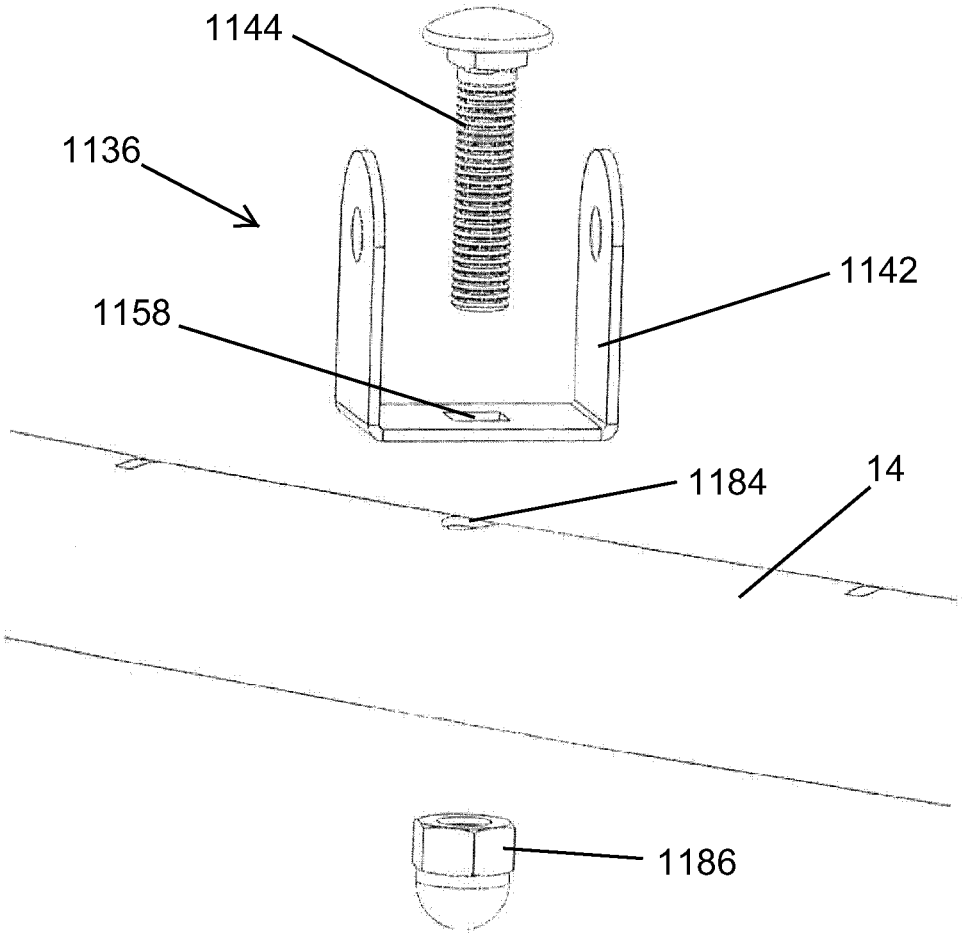
FIG. 11 is an exploded perspective view of a portion of the base frame and still another embodiment of a base connector usable with the present invention.

FIG. 11 is an exploded perspective view of a portion of the base frame 14 and still another embodiment of a base connector 1136 usable with the present invention. As illustrated, the base connector 1136 is somewhat similar to the base connectors 636, 736 illustrated and described above in relation to FIG. 6A and FIG. 7A, respectively. However, in this embodiment, the base connector 1136 is designed without a collar, and the connector base 1142 is directly connected to the base frame 14. Additionally, the connector attacher 1144 is somewhat longer than in the previous embodiments so that the connector attacher 1144 can extend through the attacher aperture 1158 and through a frame aperture 1184 that extends substantially vertically through the base frame 14. Still further, also illustrated in FIG. 11 is an attacher retainer 1186 to maintain the connector base 1142 securely connected to the base frame 14. In particular, the attacher retainer 1186 is internally threaded so as to effectively receive and retain the externally threaded portion of the connector attacher 1144.

While a number of exemplary aspects and embodiments of a trampoline 10 have been discussed above, those of skill in the art will recognize certain modifications, permutations, additions and sub-combinations thereof. Accordingly, it is to be understood that it is merely illustrative of the presently preferred embodiments of the invention. No limitations are intended to the details of construction or design herein shown.

What is claimed is:

1. An enclosure assembly for use with a trampoline assembly, the trampoline assembly including a base frame, the enclosure assembly comprising:

a plurality of support arches including at least a first support arch, a second support arch, and a third support arch that are hingably secured to the base frame, wherein the second support arch overlaps the first support arch and is selectively secured to the first support arch, wherein the third support arch overlaps the second support arch and is selectively secured to the second support arch, wherein the plurality of support arches cooperate to extend substantially fully around a perimeter of the base frame, the plurality of support arches being selectively movable between an upright configuration and a collapsed configuration, and wherein when the plurality of support arches are in the upright configuration (i) an inner edge of the first support arch is connected to an outer edge of each of two of the other support arches, (ii) an outer edge of the second support arch is connected to an inner edge of each of two of the other support arches, (iii) an inner edge of the third support arch is connected to an outer edge of one of the other support arches, and (iv) an outer edge of the third support arch is connected to an inner edge of one of the other support arches.

2. The enclosure assembly of claim 1 wherein the third support arch overlaps the first support arch and is selectively secured to the first support arch.

3. The enclosure assembly of claim 1 wherein the plurality of support arches further includes a fourth support arch that is hingably secured to the base frame, the fourth support arch overlapping the third support arch and being selectively secured to the third support arch.

4. The enclosure assembly of claim 3 wherein the fourth support arch overlaps the first support arch and is selectively secured to the first support arch.

5. The enclosure assembly of claim 1 wherein when the second support arch is in the upright configuration, one or more of the other support arches are inhibited from being moved from the upright configuration to the collapsed configuration.

6. The enclosure assembly of claim 1 wherein when the first support arch is in the collapsed configuration, one or more of the other support arches are inhibited from being moved from the collapsed configuration to the upright configuration.

7. The enclosure assembly of claim 1 wherein when the plurality of support arches are in the collapsed configuration, the support arches are positioned substantially within the perimeter of the base frame.

8. The enclosure assembly of claim 1 further comprising an enclosure that is selectively coupled to the plurality of support arches.

9. A trampoline assembly including a base frame and the enclosure assembly of claim 1.

10. An enclosure assembly for use with a trampoline assembly, the trampoline assembly including a base frame, the enclosure assembly comprising:

a plurality of support arches that are hingably secured to the base frame and that are selectively movable between a collapsed configuration and an upright configuration, wherein the plurality of support arches cooperate to extend substantially fully around a perimeter of the base frame, the plurality of support arches including at least a first support arch, a second support arch, and a third support arch, wherein the second support arch overlaps the first support arch and is selectively secured to the first support arch, wherein the third support arch overlaps the second support arch and is selectively secured to the second support arch, wherein when the plurality of support arches are in the collapsed configuration, the positioning of the first support arch inhibits the second support arch and the third support arch from being moved from the collapsed configuration to the upright configuration, and wherein when the plurality of support arches are in the upright configuration, the positioning of the third support arch inhibits the first support arch and the second support arch from being moved from the upright configuration to the collapsed configuration.

11. The enclosure assembly of claim 10 wherein the plurality of support arches further includes a fourth support arch that is hingably secured to the base frame, the fourth support arch overlapping the third support arch and being selectively secured to the third support arch.

12. The enclosure assembly of claim 11 wherein the fourth support arch overlaps the first support arch and is selectively secured to the first support arch.

13. The enclosure assembly of claim 10 wherein when the plurality of support arches are in the collapsed configuration, the support arches are positioned substantially within the perimeter of the base frame.

14. The enclosure assembly of claim 10 further comprising an enclosure that is selectively coupled to the plurality of support arches.

15. A trampoline assembly including a base frame and the enclosure assembly of claim 10.

16. The enclosure assembly of claim 1 wherein when the plurality of support arches are in the upright configuration, (i) an inner edge of the first support arch is selectively secured to an outer edge of the second support arch and an outer edge of the third support arch; (ii) the outer edge of the second support arch is selectively secured to the inner edge of the first support arch and an inner edge of the third support arch; (iii) the outer edge of the third support arch is selectively secured to the inner edge of the first support arch; and (iv) an inner edge of the third support arch is selectively secured to the outer edge of the second support arch.

17. The enclosure assembly of claim 3 wherein when the plurality of support arches are in the upright configuration, (i) an inner edge of the first support arch is selectively secured to an outer edge of the second support arch and an outer edge of the fourth support arch; (ii) the outer edge of the second support arch is selectively secured to the inner edge of the first support arch; (iii) an inner edge of the second support arch is selectively secured to an outer edge of the third support arch; (iv) the outer edge of the third support arch is selectively secured to the inner edge of the second support arch; (v) an inner edge of the third support arch is selectively secured to the outer edge of the fourth support arch; and (vi) the outer edge of the fourth support arch is selectively secured to the inner edge of the third support arch and the inner edge of the first support arch.

18. The enclosure assembly of claim 3 wherein the plurality of support arches further includes a fifth support arch that is hingably secured to the base frame, the fifth support arch overlapping the fourth support arch and being selectively secured to the fourth support arch.

19. The enclosure assembly of claim 18 wherein the fifth support arch overlaps the first support arch and is selectively secured to the first support arch.

20. The enclosure assembly of claim 10 wherein the third support arch overlaps the first support arch and is selectively secured to the first support arch.

21. The enclosure assembly of claim 10 wherein when the plurality of support arches are in the upright configuration (i) an inner edge of the first support arch is connected to an outer edge of each of two of the other support arches, and (ii) an outer edge of the second support arch is connected to an inner edge of each of two of the other support arches.

22. The enclosure assembly of claim 10 wherein when the plurality of support arches are in the upright configuration, (i) an inner edge of the first support arch is selectively secured to an outer edge of the second support arch and an outer edge of the third support arch; (ii) the outer edge of the second support arch is selectively secured to the inner edge of the first support arch and an inner edge of the third support arch; (iii) the outer edge of the third support arch is selectively secured to the inner edge of the first support arch; and (iv) an inner edge of the third support arch is selectively secured to the outer edge of the second support arch.

23. The enclosure assembly of claim 11 wherein when the plurality of support arches are in the collapsed configuration, the positioning of the first support arch inhibits the second support arch, the third support arch and the fourth support arch from being moved from the collapsed configuration to the upright configuration, and wherein when the plurality of support arches are in the upright configuration, the positioning of the fourth support arch inhibits the first support arch, the second support arch and the third support arch from being moved from the upright configuration to the collapsed configuration.

24. The enclosure assembly of claim 11 wherein when the plurality of support arches are in the upright configuration, (i) an inner edge of the first support arch is selectively secured to an outer edge of the second support arch and an outer edge of the fourth support arch; (ii) the outer edge of the second support arch is selectively secured to the inner edge of the first support arch; (iii) an inner edge of the second support arch is selectively secured to an outer edge of the third support arch; (iv) the outer edge of the third support arch is selectively secured to the inner edge of the second support arch; (v) an inner edge of the third support arch is selectively secured to the outer edge of the fourth support arch; and (vi) the outer edge of the fourth support arch is selectively secured to the inner edge of the third support arch and the inner edge of the first support arch.

25. The enclosure assembly of claim 11 wherein the plurality of support arches further includes a fifth support arch that is hingably secured to the base frame, the fifth support arch overlapping the fourth support arch and being selectively secured to the fourth support arch.

26. The enclosure assembly of claim 25 wherein the fifth support arch overlaps the first support arch and is selectively secured to the first support arch.

* * * * *